US008029422B2

(12) United States Patent
Strong et al.

(10) Patent No.: US 8,029,422 B2
(45) Date of Patent: Oct. 4, 2011

(54) MARTIAL ARTS STRIKING DEVICE WITH FLEXIBLE, NON-FORCE IMPACT, RELATIVELY NON-RESISTANT CONTACT, STRIKING TARGETS, AND METHOD OF USE

(76) Inventors: Patrick Strong, Long Beach, CA (US); David R. Strong, Long Beach, CA (US)

( * ) Notice: Subject to any disclaimer, the term of this patent is extended or adjusted under 35 U.S.C. 154(b) by 0 days.

(21) Appl. No.: 12/626,079

(22) Filed: Nov. 25, 2009

(65) Prior Publication Data

US 2010/0130333 A1 May 27, 2010

Related U.S. Application Data

(60) Provisional application No. 61/117,962, filed on Nov. 26, 2008.

(51) Int. Cl.
*A63B 21/00* (2006.01)

(52) U.S. Cl. ..... 482/83; 482/90

(58) Field of Classification Search ..... 116/173; 482/83–90; 40/218
See application file for complete search history.

(56) References Cited

U.S. PATENT DOCUMENTS

| | | | | |
|---|---|---|---|---|
| 1,383,234 | A * | 6/1921 | Raguse | 116/173 |
| 4,546,966 | A * | 10/1985 | Segura | 482/88 |
| 4,974,833 | A * | 12/1990 | Hartman et al. | 482/3 |
| 5,253,608 | A * | 10/1993 | Burke | 116/173 |
| 6,263,011 | B1 * | 7/2001 | Paik et al. | 375/149 |
| 6,302,831 | B1 * | 10/2001 | Henry | 482/83 |
| 2009/0151068 | A1 * | 6/2009 | Rice | 4/558 |

* cited by examiner

*Primary Examiner* — Jerome W Donnelly
(74) *Attorney, Agent, or Firm* — Buche & Associates, P.C.; John K. Buche

(57) ABSTRACT

A martial arts striking device and method of use that overcomes the relatively hard force impact and resistance disadvantages of all prior striking devices for martial arts, boxing, and physical fitness by allowing visibly targeted "non-force impact" (meaning relatively less forceful impact) striking at relatively "non-resistant contact" targets to enhance speed and power while using less effort. Said striking targets can be substantial in size and made of a lightweight flexible material or fabric that reacts with a spontaneous refresh rate when struck, thereby simulating a live opponent. Said striking targets can be easily suspended from a variety of existing structures or specially produced frames and supports to form familiar punching bag shapes, enclosures, or to simulate being surrounded by multiple opponents. In contrast to prior art objects, said striking device is light in weight, easier to mount, noiseless when used, and suitable for safe home use.

3 Claims, 14 Drawing Sheets

MARTIAL ARTS STRIKING DEVICE WITH FLEXIBLE, NON-FORCE IMPACT, RELATIVELY NON-RESISTANT CONTACT, STRIKING TARGETS, AND METHOD OF USE

CROSS-REFERENCE TO RELATED APPLICATIONS

This application claims the benefit of U.S. Prov. Pat. App. Ser. No. 61/117,962 (filed Nov. 26, 2008) entitled "A Martial Arts Striking Device with Flexible, Non-force Impact, Relatively Non-resistant Contact, Striking Targets, and Method of Use."

STATEMENT REGARDING FEDERALLY SPONSORED RESEARCH OR DEVELOPMENT

N/A

BACKGROUND OF THE INVENTION

1. Field of Invention

The present invention relates to martial arts, physical fitness, exercise and sports equipment, more particularly to striking devices, and more particularly to punching bags; directed to a new technology and method of use that comprises relatively non-resistant contact striking targets made of flexible materials or fabrics, for "non-force impact" training and exercise.

2. Background of the Invention

Martial arts, boxing, and basic self-defense skills are studied all over the world, in some form or another, with practitioners at all skill levels known to use striking devices, such as punching bags, to provide physical targets to be struck. The largest known is the heavy bag used for footwork, power and physical conditioning. Traditional heavy bags simulate the general size and weight of a human opponent and come in a variety of lengths, diameters, and weights, with some weighing well over one hundred pounds. In the past, heavy bags were typically found in martial arts studios, boxing gyms, and health clubs. More recently, they have found their way into the homes, patios, and garages of consumers. However, for most people, heavy bags for home use are not realistic or practical. For example, heavy bags are generally hung from a ceiling supported by rope, chain or other apparatus that must be fixedly attached to weight bearing or reinforced structures. Springs may also be included to help dampen heavy vibration transfer and noise though walls. Or they may be suspended from a large, sturdy structure that takes up extra space, or mounted upright on a stable base filled with water, sand, concrete or other weighted material that is heavy and difficult to move once filled for weight. Heavy bags are constructed of a durable exterior such as leather, vinyl, or canvas, and are filled with impact absorbing materials for receiving hard force impact strikes. Heavy bags tend to bounce or swing when being struck and do not realistically react by fastly shaping and reshaping as would a live opponent. It would be desirable, therefore, to produce a striking device that is light in weight and is the general size and shape of a heavy bag, takes up little space, and is easy to move and mount without the concern for weight bearing structures or vibration transfers and noise through walls and ceilings. It would be further desirable to produce a striking device that is light in weight so that it does not require being suspended from either a large, sturdy upright structure, or stand upright on a stable base that is difficult to move when weighted and takes up extra space where area is limited, such as in the home. It would be further desirable to produce a striking device that provides a spontaneous refresh rate that realistically reacts by fastly shaping and reshaping when being struck, as would a live opponent.

Self-defense instructors and trainers know that the act of striking with relatively hard force impact builds power, however, it also sends rebound energy back to the user that slows speed and clogs continuity when striking in combinations. To solve this problem, the lighter and "more lively" types of training bags, such as the light bag, timing bag, and small speed bag, are used for specific types of exercises that train more efficient short arm and fist movements to deliver faster repetitive strikes, develop timing and sharpen hand-eye coordination. However, unlike the heavy bag, the smaller training bags do not simulate a full-size opponent to be targeted and struck. Nor do heavy bags, nor training bags enable the user to accurately analyze and correct technical mistakes by striking with relatively non-force impact, such as when shadow boxing, or performing the choreographed patterns of movements in martial arts forms (kata) that help develop structure, balance, and precision of technique. It would be desirable, therefore, to produce a striking device that does not send rebound energy back to the user that can slow speed and clog continuity. It would be further desirable to produce a striking device that combines the heavy bag's advantages of targeted striking at a simulated, full-size opponent, with the advantages of the lighter "more lively" action of smaller training bags. It would be further desirable to produce a striking device that provides the ability to accurately analyze and correct technical mistakes, as when shadow boxing, or performing the choreographed patterns of movements in martial arts forms.

Forms and shadow boxing are important for training advanced skills, burning calories, cardiovascular conditioning, balance, core strength, stamina, and endurance as evident in boxing, where a fighter burns more energy and effort missing his opponent than hitting him. The shared disadvantage, of both forms and shadow boxing, is that the user loses the ability to visibly target an actual object in order to accurately measure distance, timing, and effect of strikes. It would be therefore, desirable to produce a striking device that provides the "visible targeting" for accurately measuring distance, timing, and effects of strikes when practicing forms and shadow boxing. Self-defense instructors and trainers know that in order to teach well-rounded striking skills, they must rely on separate pieces of equipment for training different exercises. However, additional pieces of equipment and bags take up space and can be expensive, making them not well suited for the home or users on a tight budget. It would be therefore desirable to produce a striking device that combines the usages of multiple pieces of equipment into a single unit.

Alternatively, some striking devices require that they be disassembled for different exercises or in order to save space, resulting in wasted time and preventing training multiple exercises and techniques together in rapid succession. It would be desirable, therefore to produce a striking device that does not require being disassembled by the user to save space or to train multiple exercises together in rapid succession. It would be further desirable to provide a striking device that can be immediately and effortlessly collapsible and stored for saving space when not in use.

A further problem arises when additional pieces of equipment are required to simulate training against multiple opponents. In order to solve this problem one such striking device, The Master Fighter, by Self Defense Systems, is comprised of a single platform of fabricated steel, supporting multiple heavy-duty, force-impact absorbing pads to form a large enclosure. However, this type of device is not well suited for home use because it is noisy when struck, substantially space consuming, weighs hundreds of pounds, is difficult to move, and in addition to costing many thousands of dollars, it is expensive to ship and difficult to install. It would be therefore desirable to produce a striking device that is noiseless when struck, modest in size, lightweight, relatively low in cost, and can be easily configured to simulate being surrounded by multiple opponents.

Many of the old Martial Arts Masters believe the highest level in martial art comes from the harmony of both the "hard and soft sides" of their art, as represented in the Taoist tenet, "Yin and Yang." Gichen Funakoshi, the father of modern karate, was known to have demonstrated his mastery when breaking a makawara striking board, in front of his most advanced students, with what appeared to be a seemingly effortless strike. Similarly, the most revered martial arts film star in history, the late Bruce Lee, divided his training to both hard and soft striking methodologies. Lee's force impact training was practiced on wooden dummies and heavy bags. Yet, his amazing speed and power he credited to the soft side, which included striking relatively non-resistant contact, visible targets, such as a piece of paper hanging on the end of a string, a small leaf on a low branch, or a lit candle, in which the retraction speed of his strike would suck out the flame. By training with visibly targeted, non-force impact, relatively non-resistant contact methods, Lee was able to program his mind and body with the ancient teachings of Taoism's Yin and Yang and its powerful sister tenets, "Wu Wei," meaning, "the not doing," or "letting it happen," and "Wei Wu Wei," meaning, "the soft and invisible power," or "effortless doing." There is no known prior art striking device, nor is there known of any attempt to produce a striking device that helps the user learn to strike with greater speed and power while using less effort, as taught through ancient Taoist principles. It would be desirable, therefore, to provide a striking device that helps the user practice the "soft side" of striking in the way of ancient Taoist principles for developing faster speed and more powerful strikes while using less effort.

Youth striking bags are commonly made of a lightweight plastic, rubber, or vinyl, and can be filled with soft foam or inflated with air, such as the Bounce-back Bag, by Everlast Worldwide Inc., for children generally between the ages four to eleven. However, due to their wide bounce-back radius, and non-stable base, they can sway wildly or even launch when struck to cause damage to property, making them not well suited for safe home use. Additionally, their unrealistic response to strikes impedes development of proper skills for boxing and martial arts. Furthermore, striking devices made for children are often constructed of inexpensive, low quality materials and are prone to damage and frequent air leakage, making them not well suited for normal daily use. It would be, therefore, desirable to produce a striking device that is suitable for children and made with quality materials that do not degrade or leak air, is safe and appropriate for home use, and can be used for developing proper skills in boxing and martial arts.

Professional martial artists and boxers know that they must be consistent in training to avoid erosion of skills over time, and that their frequency of training should not be limited for reasons of inaccessibility or making noise that disturbs others. It would be, therefore, desirable to produce a striking device that can be immediately accessible within the living areas of the home, such as a bedroom, den, or office, and is "noiseless" when struck, so that user can train in the home, day or night, without disturbing others.

Professional athletes know that consistency in practice time and high repetitions improves complex motor skills. However, high amounts of repetition movement performed incorrectly can lead to poor skills and the risk of injury from overuse. It would be, therefore, desirable to produce a striking device that encourages increased practice sessions, practice time, volume of repetition movements of striking at targets without the risk of injuries from overuse. It would be further desirable to produce a striking device that allows users to continue training through slight to moderate injuries, such as a hamstring pull. It would be further desirable to produce a striking device that can be used by career professionals, such as surgeons, musicians, and artists, who wish to train in boxing and martial arts without risking injury to their hands. It is further desirable to produce a striking device that allows the practice of exercising high repetitive, multiple-planes of relatively non-resistant contact movements for increasing range of motion, safe muscle strengthening, high amounts of synovial fluid production, and hydration of joints and muscles for therapeutic modalities, such as physical therapy, injury recovery and health maintenance.

It is recommended, for users of striking devices and punching bags, that bag gloves, boxing gloves, hand-wraps, or bandages are worn to provide proper protection to the knuckles, thumbs, wrists, and bones of the hand from rigorous and repeated hard force impact striking. This is why traditional hard force impact striking exercises are generally unsuitable for people suffering from physical ailments, such as arthritis or injured joints. It would be, therefore, desirable to produce a striking device that does not require protective equipment for normal use, and makes traditional striking exercises suitable and safe for seniors and sufferers of physical ailments. It would further be desirable to produce a striking device that is appropriate for use by or anyone with fragile bones, a degenerative disease, physical disability, and those confined to wheelchairs.

Some striking devices are simple striking pads or shields to be hand-held by a second training partner and presented at various positions and orientations, allowing the first user to target and train multiple techniques in rapid succession. However, it is not always possible or practical to train in this way, as it is dependent on the availability of a training partner. It would be desirable, therefore, to produce a striking device that can be hand-held as well as fixedly attached to a ceiling, wall, or doorway for times when a training partner is not available.

There is no prior art striking device that is suited for the higher sensitivity training and techniques of some martial arts, such as "sticking hands." Therefore, it would be desirable to produce a striking device that provides a system of instantly responsive, flexible striking targets that can provide significant stimulation for tactile, higher sensitivity techniques.

Accordingly, advantages of the present invention are to produce a non-force impact martial arts striking device with relatively non-resistant contact striking targets: (a) that combines distinct advantages of targeted "force impact" striking with "non-force impact" striking; (b) that provides "visible targeting" with the ability to accurately analyze and correct technical mistakes as when shadow boxing, or performing the choreographed patterns of movements in martial arts forms; (c) that combines the advantage of simulating a full-size opponent used for targeted striking of the heavy bag with the advantages of the lighter "more lively" action of the smaller training bags; (d) that allows the user to learn to train the "soft side" of striking in accordance with ancient Taoist principles for delivering greater speed and power while using less effort; (e) that does not send rebound energy back to the user that can slow speed and clog continuity; (f) that eliminate the user's expectation of hard impact forces that otherwise impede building speed, continuity, and penetration skills; (g) that allows the user to strike with non-force impact, such as when a boxer burns more energy and effort missing his opponent than hitting him, so that the user can burn more calories, build cardiovascular fitness, core strength, stamina, and endurance; (h) that does not require the use of protective equipment, such as bag gloves, boxing gloves, hand wraps, and bandages for protecting the wrists, thumbs, knuckles, and bones of the hands from injury; (i) so that all striking areas of the body, including the head, shins, elbows, knees, and fingertips, can be used repetitively without the risk of injury and need for protective equipment; (j) that allows users to increase volume and repetitions of striking targets without the potential of injuries from overuse; (k) that allows a user to continue training through slight to moderate, non-related injuries; (l) that career professionals, such as surgeons, musicians, and artists, can continue to train in boxing and martial arts without risk of injuries to their hands; (m) that non-force impact movement exercises can be used in therapeutic modalities, such as physical therapy, injury recovery and health maintenance; (n) that is attractive in appearance so that it is well suited for home use as a training device as well as a decorative piece; (o) that offers "noiseless" training so that it can be used day or night within the home or office without disturbing others; (p) that is easily collapsible so that it can be reduced in size to save space when not in use; (q) that is low in cost and modular so that users may custom build and expand their units to add features and capabilities; (r) that can be easily disassembled and packed for travel so that it can be used as a portable training unit; (s) that is neither heavy nor bulky so that it can be packaged and shipped inexpensively to customers in the smallest possible containers; (t) that is light in weight so that it does not require weight baring or reinforced structures for mounting, or springs that help dampen the transfer of vibrations and noise through walls and ceilings; (u) that react to being struck without bouncing and colliding into objects, so that valuable property in the home is not destroyed; (v) that is light in weight so that it can optionally mount onto a standing floor base without the additional need to be filled with water, sand, concrete or other heavy material; (w) that provides a plurality of independent targets so that the user is presented with a variety of striking options and angles; (x) that can form a substantial cylindrical enclosure in the shape of a typical heavy punching bag, so that the user is able to strike high and low and at all angles as though hitting and moving with a real opponent; (y) that provides gaps between targets so that spaces can be progressively narrowed to create more challenge when striking for developing greater accuracy and precision; (z) that is suspended from the ends of spaced apart, outwardly reaching, sliding telescopic arms so that more striking targets can be added; (aa) that can be swiveled horizontally at the ends of said arms so that the angle of attack can be varied; (bb) that provides an expandable enclosure of independent targets so that the user can train within the device, such as when practicing 360 degrees standing kicking drills and combinations or long-range striking techniques; (cc) that combine the usages of multiple pieces of equipment into a single unit that can be configured to simulate being surrounded by multiple opponents; (dd) that can be easily adjustable in height and dimension so that it can be used to suit both adults and children; (ee) that combines multiple usages and training exercises into one unit so that multiple pieces of equipment are not needed, saving costs and valuable space; (ff) that allows for training multiple exercises and techniques together and in rapid succession without wasting valuable training time disassembling and reassembling the device; (gg) that allows users to develop advanced footwork patterns for hiding, stealing, and closing distances; (hh) that can be translucent so that the user has the advantage of visual depth of field to help measure proper target penetration when striking; (ii) that can be configured in manner so that multiple users can train on one device at the same time; (jj) that can combine the advantage and usage of being hand-held by a training partner and/or fixedly attached to a ceiling, wall, or doorway when a training partner is not available; (kk) that can be removably attached to a wide variety of overhead supports, frames, doorframes, or suspensions systems; (ll) that can provide a multiplicity of individual training stations to economically fill a group training area such as an aerobics room or martial arts studio; (mm) that are translucent so that multiple users can see through targets to help avoid one another, train safely, and see their instructor while training on either the same device or in a group training room having multiple stations; (nn) that spontaneously react and move when being struck so that the user develops hand-eye coordination, reaction timing, and speed; (oo) that spontaneously react when being struck so that the user can practice more complex punching combinations, as practiced on the speed bag, but without its difficult laws of rhythm and counting rebounds; (pp) that spontaneously react and refresh differently to every kind of strike, kick, or combination, as would a live opponent; (qq) that are suspended in a slightly curved manner to provide a better reshaping action and simulation of a real opponent; (rr) that is durable to withstand a considerable amount of abuse without deterioration from long-term repeated impact; (ss) that can be configured to provide sensitivity for training martial arts' techniques, such as sticking hands; (tt) that can interact with electronics so that the user can receive the benefits of biofeedback and instructional aids during training workouts; and, (uu) that can have printed, projected, or displayed images on their surfaces, such as a boxer, martial artist, street fighter, movie hero or villain, video game opponent, animal, or any other creature so that the image provides specific striking targets on said figures.

These and other objects will be more readily ascertainable to one skilled in the martial arts from a consideration of the following figures, description and exemplary embodiments, with the understanding the drawings are illustrative only and that changes may be made in the specific construction illustrated and described within the scope of the appended claims.

SUMMARY OF THE INVENTION

A martial arts striking device and method of use that overcomes the relatively hard force impact and resistance disadvantages of all prior striking devices for martial arts, boxing, and physical fitness by allowing visibly targeted "non-force impact" (meaning relatively less forceful impact) striking at relatively "non-resistant contact" targets to enhance speed and power while using less effort.

Said striking targets can be substantial in size and made of a lightweight flexible material or fabric that reacts with a spontaneous refresh rate when struck, simulating a live opponent. Said striking targets can be easily suspended from a variety of existing structures or specially produced frames and supports to form familiar punching bag shapes, enclosures, or to simulate being surrounded by multiple opponents. In further embodiments, outwardly reaching arms can be attached to walls, doors, and overhead frame systems to suspend additional striking targets in various configurations. In contrast to all prior art, these target systems are light in weight, easy to ship and install, and are relatively noiseless when used, making them convenient and appropriate for safe home use.

In further embodiments, images of combatants with target zones can be displayed on said flexible striking targets and a housing or deck, to hold electronic components and instructional aids, can be fixedly attached to the various frame supports. Embodiments herein are typically modular so that users may custom build and expand their striking units to add features and capabilities as desired.

BRIEF DESCRIPTION OF THE FIGURES

The manner in which these objectives and other desirable characteristics can be obtained is explained in the following description and attached figures in which.

TABLE 1

Figure 1:
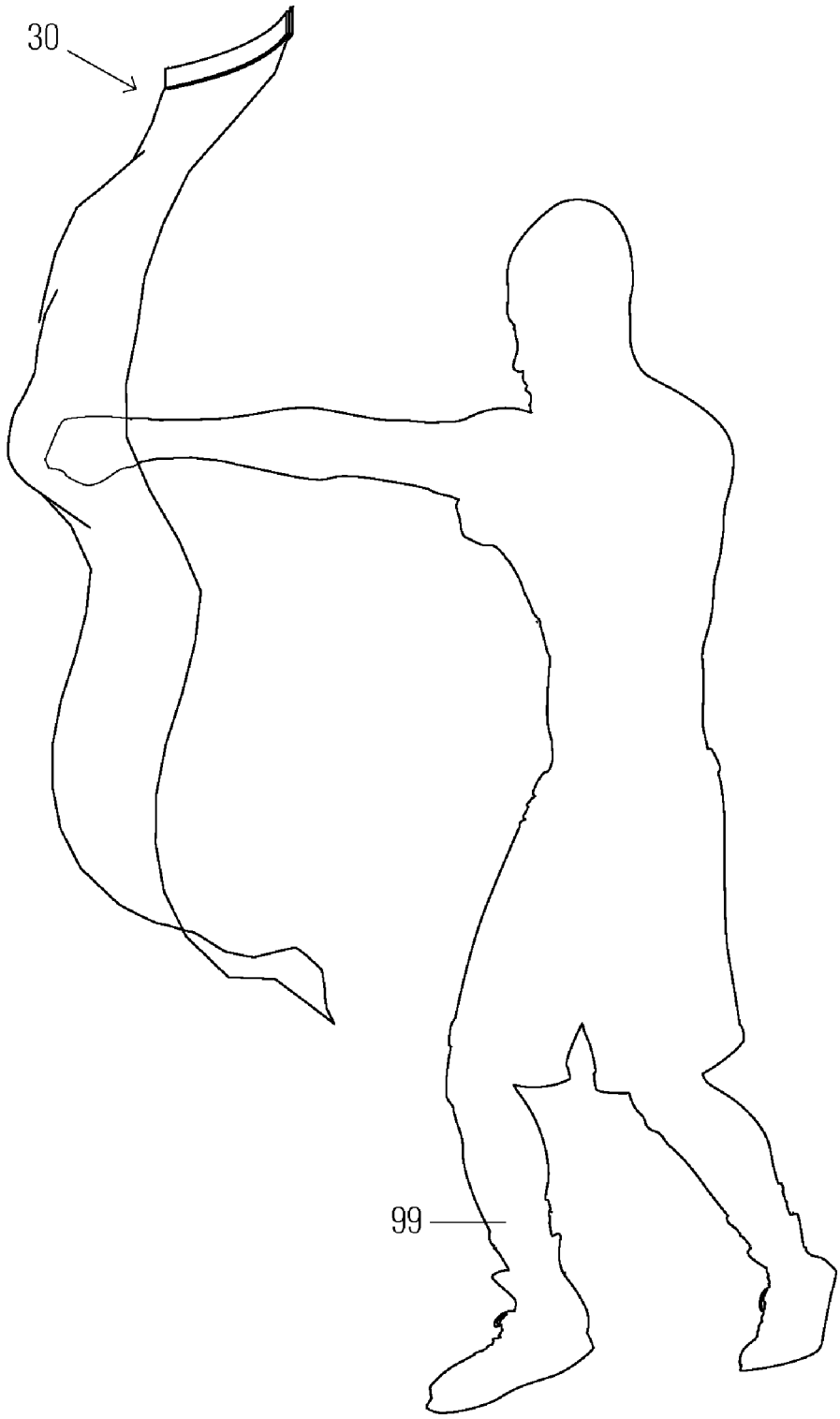
FIG. 1 is a perspective view of a first embodiment depicting a user punching a flexible striking target.

| Drawings - Reference Numerals<br>DRAWINGS - REFERENCE NUMERALS |
|---|
| 20 - sliding telescopic arm |
| 21 - outer sliding telescoping arm |
| 22 - inner sliding telescopic arm |
| 23 - arm stop sleeve |
| 24 - friction bushings |
| 25 - arm stop cap |
| 26 - T-swivel |
| 27 - curved t-head |
| 28 - T-cap |
| 29 - arm mount sleeve |
| 30 - flexible striking target |
| 31 - hook fastener strip |
| 32 - loop fastener strip |
| 33 - T-harness |
| 34 - T-harness body |
| 35 - frame harness |
| 36 - frame harness body |
| 37 - fastening strap |
| 38 - flexible target material |
| 39 - displayed combatant image |
| 40 - overhead frame |
| 41 - frame mount |
| 50 - flexible mount |
| 51 - frame clamp |
| 52 - central ring |
| 53 - flexible gaff |
| 55 - sleeve connector |
| 56 - jointed T-swivel |
| 57 - fixed T-head |
| 58 - fixed arm |
| 59 - wall/ceiling plate mount |
| 60 - adjustable ceiling mount |

TABLE 1-continued

| Drawings - Reference Numerals<br>DRAWINGS - REFERENCE NUMERALS |
|---|
| 61 - ceiling plate |
| 62 - down rod sleeve |
| 63 - drilled holes |
| 64 - locking bolt |
| 65 - inner sliding telescopic down-rod |
| 66 - over-the-door clip |
| 67 - door |
| 68 - door frame |
| 70 - electronics enclosure |
| 71 - common nut |
| 72 - suspension bolt |
| 73 - electronic control window |
| 74 - Apple iPod Video ® |
| 75 - frame deck |
| 80 - swing arm |
| 81 - swing arm section |
| 85 - upper tension bolt |
| 86 - lower receiving nut |
| 87 - swing T-head |
| 88 - swing T-cap |
| 89 - swivel joint |
| 90 - swing mount |
| 92 - securing knob |
| 93 - frame swing hinge |
| 94 - wall frame mount |
| 95 - wall frame shaft |
| 96 - end cap |
| 99 - user |

It is to be noted, however, that the appended figures illustrate only typical embodiments of this invention, and therefore, are not to be considered limiting of its scope, for the invention may admit to other equally effective embodiments that will be appreciated by those reasonably skilled in the relevant arts. Also, figures are not necessarily made to scale.

DETAILED DESCRIPTION OF PREFERRED EMBODIMENTS

A first embodiment of a martial arts striking device is disclosed and generally designated as FIG. 1, depicting a user 99 punching a flexible striking target 30.

Said striking device consists of one-or-more flexible striking targets 30 made of a flexible material or fabric 38, that provides relatively "non-resistant contact" (meaning relatively less forceful impact) so that all striking is done with "non-force impact" to remove the rebound energy otherwise generated by all prior art striking devices. Flexible striking targets 30 combine the technical advantages of non-force impact training with the targeting advantages of all prior art, force impact striking devices. Targeted force impact striking builds speed, timing, rhythm, and coordination, while non-force impact striking builds proper body structure, balance, continuity of movement, and precision of technique. "Targeted non-force impact" striking combines these benefits while training the user 99 how to deliver greater speed and power while using less effort, as described in ancient Taoist principles.

Flexible striking target 30 simulates the fastly shaping and reshaping action of a live opponent when being struck so that the user 99 develops coordination, reaction timing, and speed. This spontaneous refresh rate allows a user 99 to practice more complex punching combinations, as on a speed bag, but without its difficult laws of rhythm and counting rebounds. Flexible striking targets 30 also offer "noiseless" training so that they can be used day or night within the home or office without disturbing others.

Flexible striking targets 30 allow users 99 to strike with all parts of the body, including the head, shins, elbows, knees, and fingertips, repetitively without the risk of injury and need for protective equipment required by all prior art striking devices, such as bag gloves, boxing gloves, hand wraps, and bandages. This allows users to safely increase the volume of practice sessions and repetitions, thus improving skills more quickly. It also means that users do not have to risk timely layoffs from training due to injuries, which is especially important to skilled professionals that rely on their hands, such as surgeons, musicians, and artists.

Flexible striking targets 30 can be used safely by growing children, seniors, the physically handicapped, such as the blind, those confined to wheelchairs or with disabilities and are well suited for therapeutic modalities, such as physical therapy, injury recovery and health maintenance; through the practice of exercising high repetitive, multiple-planes of relatively non-resistant contact movements for increasing range of motion, safe muscle strengthening, synovial fluid production, and hydration of joints and muscles.

Flexible striking targets 30 can be either an opaque or translucent material or fabric, such as but not limited to a silk or nylon, with translucent materials providing a visual, three-dimensional depth of field to aid a user 99 in evaluating target penetration while analyzing and correcting technique. Flexible striking targets 30 can be made durable to withstand a considerable amount of abuse without causing deterioration from long-term repeated impact. Additionally, a heavier material can be used, or two or more flexible striking targets may be overlapped (not shown) to increase resistance training tactile sensitivity skills, such as sticking hands.

Figure 2A:
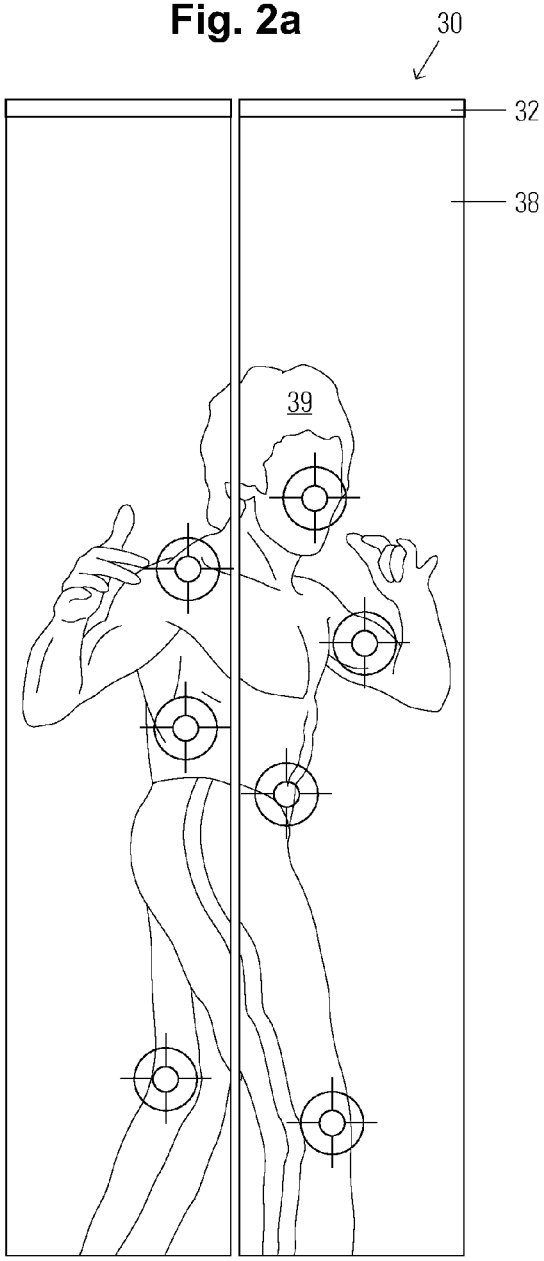
FIG. 2*a* is an interior flat view of a second embodiment flexible striking target system displaying an image of a combatant with target striking zones.

In a second embodiment, a striking device in accordance with FIG. 1, as shown in FIG. 2*a*, depicts one or more flexible striking targets 30 made of a flexible material or fabric 38 that can include a displayed combatant image 39 or target symbols. Said flexible striking targets 30 can be removably attached to a variety of rigid or flexible overhead frames structures, such as a doorframe, or any suitable supports such as but not limited to an overhead beam, pipe, rope, or cable; removably attached by any conventional means, including but not limited to hook-and-loop fasteners 32, an adhesive material, tacks, or small nails (not shown.)

Said displayed combatant image 39 illustrates a martial artist, but may replaced with a boxer, street fighter, movie or video game hero or villain, animal, or any other such creature (not shown) with or without designated target points, such as the head, solar plexus, ribs, kidneys, groin, knees, and pressure points. In all said examples, the displayed combatant image 39 on the flexible striking targets 30 reacts and reshapes as would a live opponent. Said images can also be fine artwork (not shown) suited for home appeal, and can be displayed on flexible striking targets 30 in any conventional manner, such as but not limited to direct and offset printing, silk-screening, airbrushing, hand-painting, or in any unconventional manner, such as digitally projected or electronically illuminated. Furthermore, technology that allows animated images to be displayed, as in a video game, on flexible material or fabric can also be made to receive strike information from the user 99, allowing the flexible striking target 30 into act as an interactive, "touch-screen" controller.

Figure 2B:
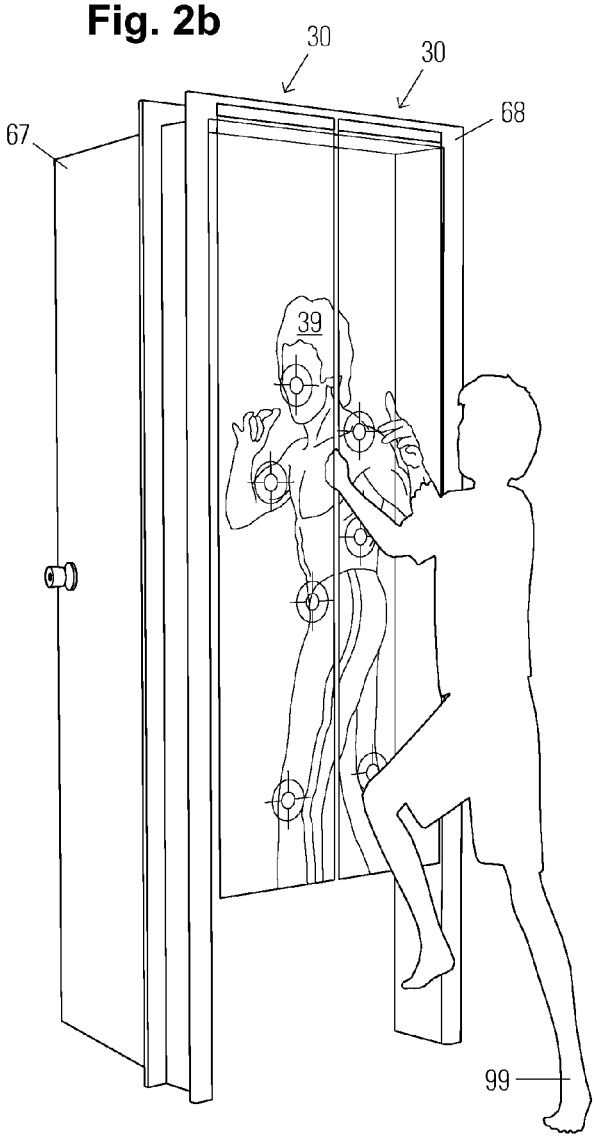
FIG. 2*b* is a perspective view of a second embodiment depicting a user punching a flexible striking target system that is suspended in a doorway.

As shown in FIG. 2*b*, said device can also act as a decorative, curtained doorway to be passed through when door is left open, which can be of particular interest to some parents whose children require monitoring. Children prompted to strike at flexible striking targets 30 upon each entry and exit can benefit from regularity and convenience of training, resulting in faster mastery of skills. Adults may also train in this manner, especially when space is limited in such area as an office, bedroom, hotel, or dorm room, and may prefer to simply remove flexible striking targets 30 when not in use.

Said flexible striking targets 30 can be made with hemmed sewn edges for adding strength and neatness (not shown).

Figure 3A:
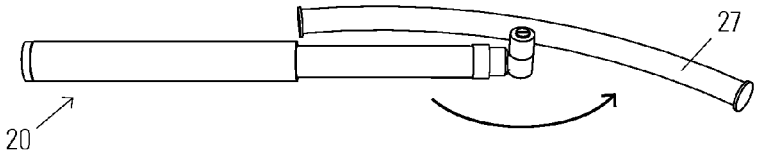
FIG. 3*a* is a perspective view of a third embodiment, hand-held, flexible striking target support, in the closed position.
Figure 3B:
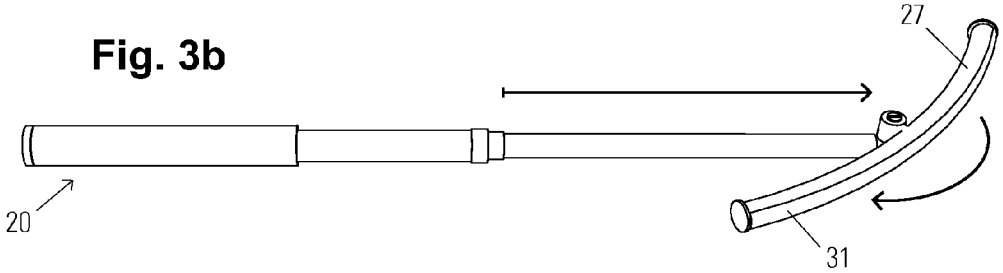
FIG. 3*b* is a perspective view of a third embodiment, hand-held, flexible striking target support, in the full open position.

In a third embodiment, the striking device in accordance with FIG. 1, as shown in FIGS. 3*a* and 3*b* are perspective views of a hand-held sliding telescoping arm 20 with a removably attached curved T-head 27 rotated laterally; made of but not limited to a metal, wood, plastic, or hollow PVC pipe. Said T-head includes a strip of hook-and-loop fasteners 31 for the removable attachment of said flexible striking targets 30.

Figure 3C:
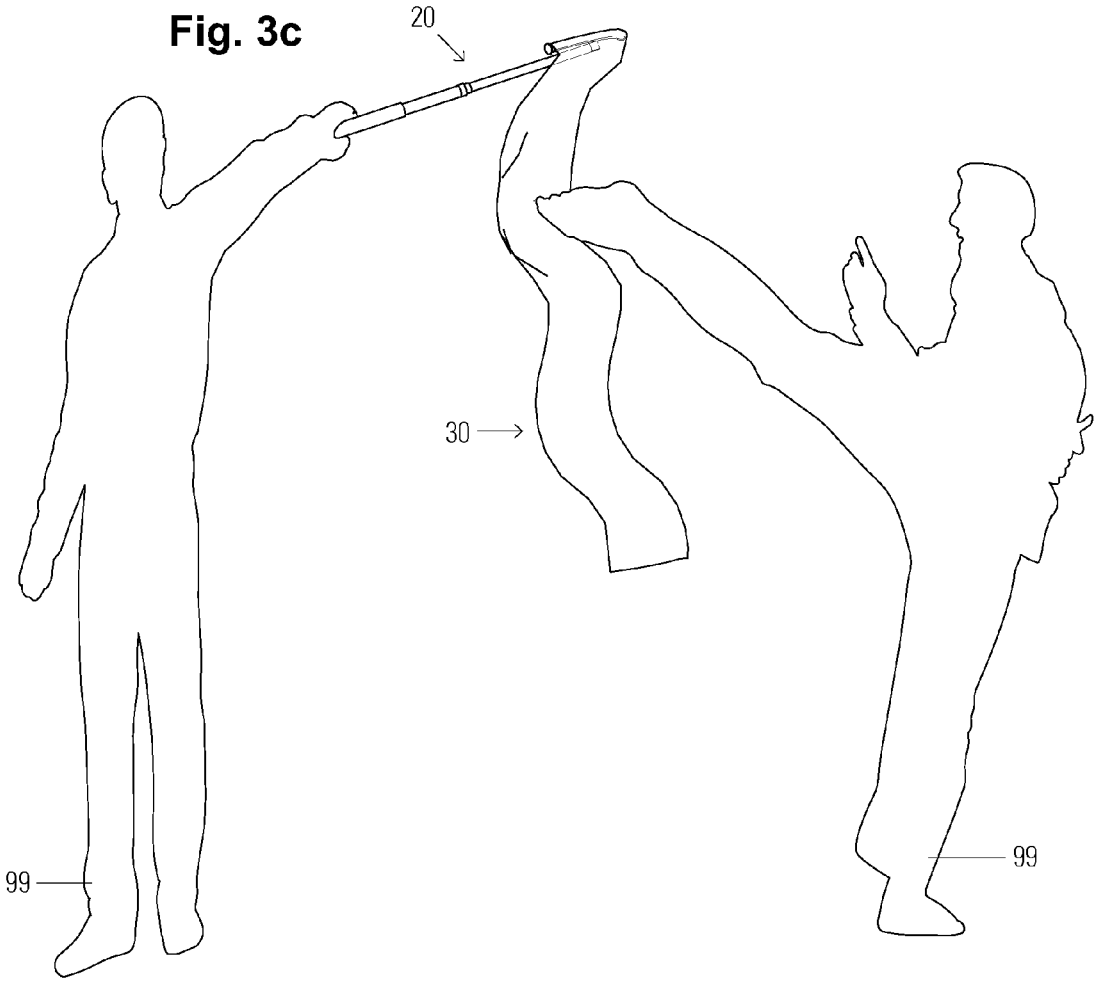
FIG. 3*c* is a perspective view of a third embodiment depicting two users training with a hand-held flexible striking target support.
Figure 11A:
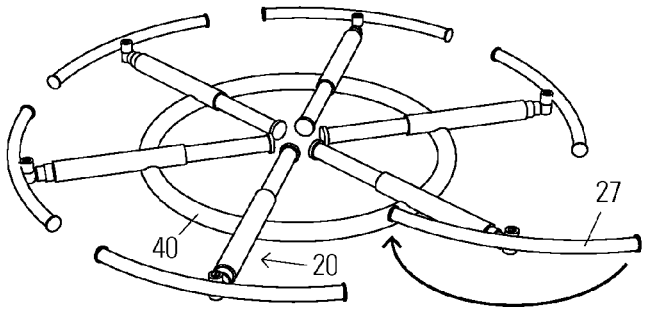
FIG. 11*a* is an upper perspective view of the overhead frame with a plurality of sliding telescoping arms attached, at the closed position.
Figure 11B:
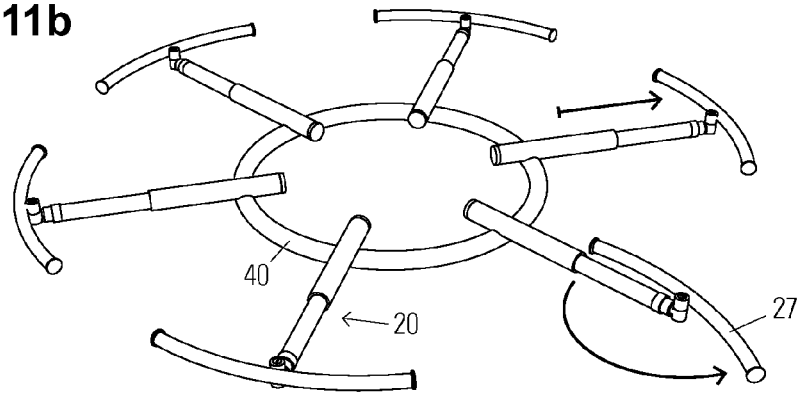
FIG. 11*b* is an upper perspective view of the overhead frame with a plurality of sliding telescoping arms attached, at the mid-open position.
Figure 11C:
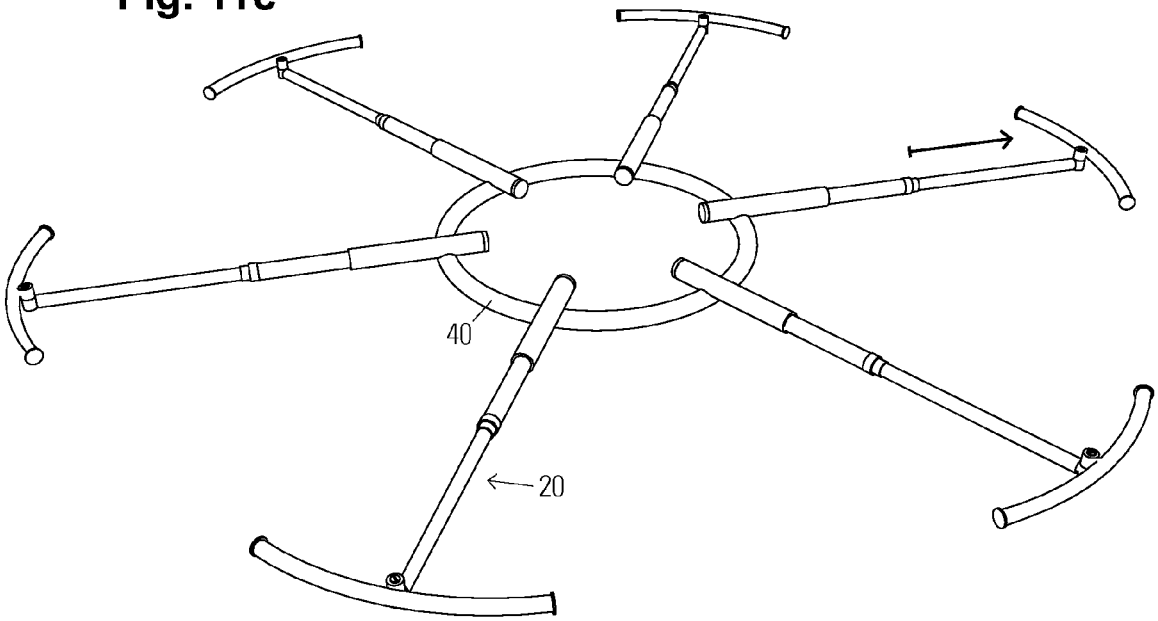
FIG. 11*c* is an upper perspective view of the overhead frame with a plurality of sliding telescoping arms attached, at the full-open position.

Suspending flexible striking targets 30 from a hand-held striking device, as shown in FIG. 3*c*, allows users 99 to simulate actual martial arts situations with a free-moving target. Flexible striking targets 30 are suspended in a slightly curved manner to provide a better reshaping action and simulation of a real opponent. Said striking device FIG. 3*c* is easily carried, portable, and can be added to other striking device variations, such as an overhead frame 40, as shown in FIGS. 11*a*-11*c*, or wall frame as shown in FIGS. 4*a*-4*b*, when a training partner is not available.

Figure 4A:
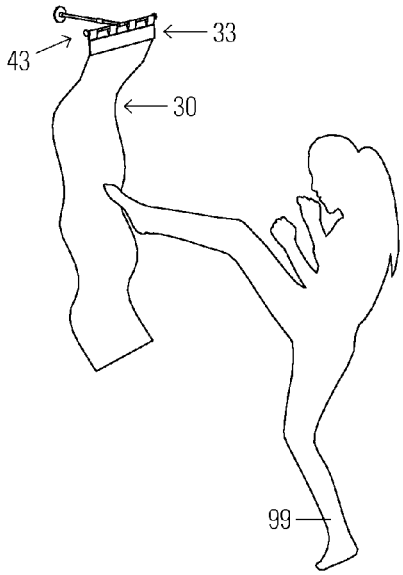
FIG. 4*a* is a perspective view of a fourth embodiment depicting a user kicking a flexible striking target suspended from an overhead ceiling mount.
Figure 4B:
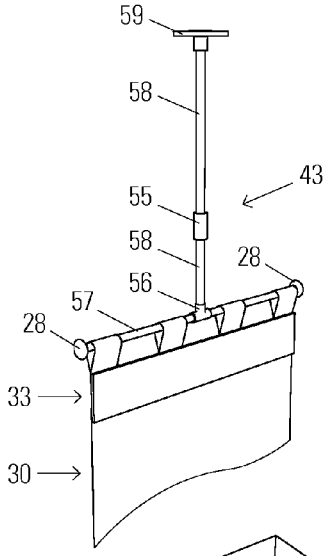
FIG. 4*b* is a perspective view of a fourth embodiment of wall mounted flexible striking target support, in the full open position.

In a fourth embodiment, the striking device in accordance with FIG. 1, as shown in FIGS. 4*a* and 4*b* are perspective views of one or more sliding telescoping arms 20 that can be fixedly attached to either a ceiling or wall (not shown) by a wall/ceiling plate mount 59. Said striking targets 30 can be removably attached to a T-harness 33, by strips of hook-and-loop fasteners 31-32. Said T-harness 33 removably attaches to the curved T-head 27 which can be adjusted for wall or ceiling use by a jointed T-swivel 56.

Figure 4C:
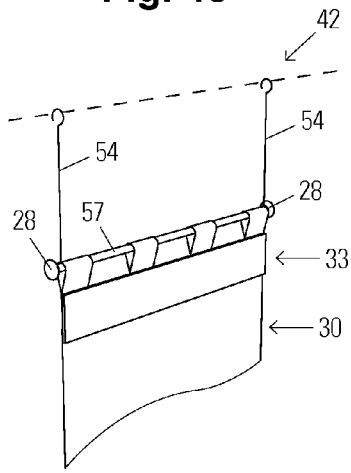
FIG. 4*c* is a perspective view of a fourth embodiment of two flexible striking targets removably attached to an overhead suspension system, such as a wire.

As shown in FIG. 4*c*, flexible striking targets 30 can be removably attached to a variety of suspension systems, consisting of but not limited to tension lines, pipes, and beams, by using a T-harness 33 having multiple fastening straps 37 and hook-and-loop fasteners 31, 32.

Figure 4D:
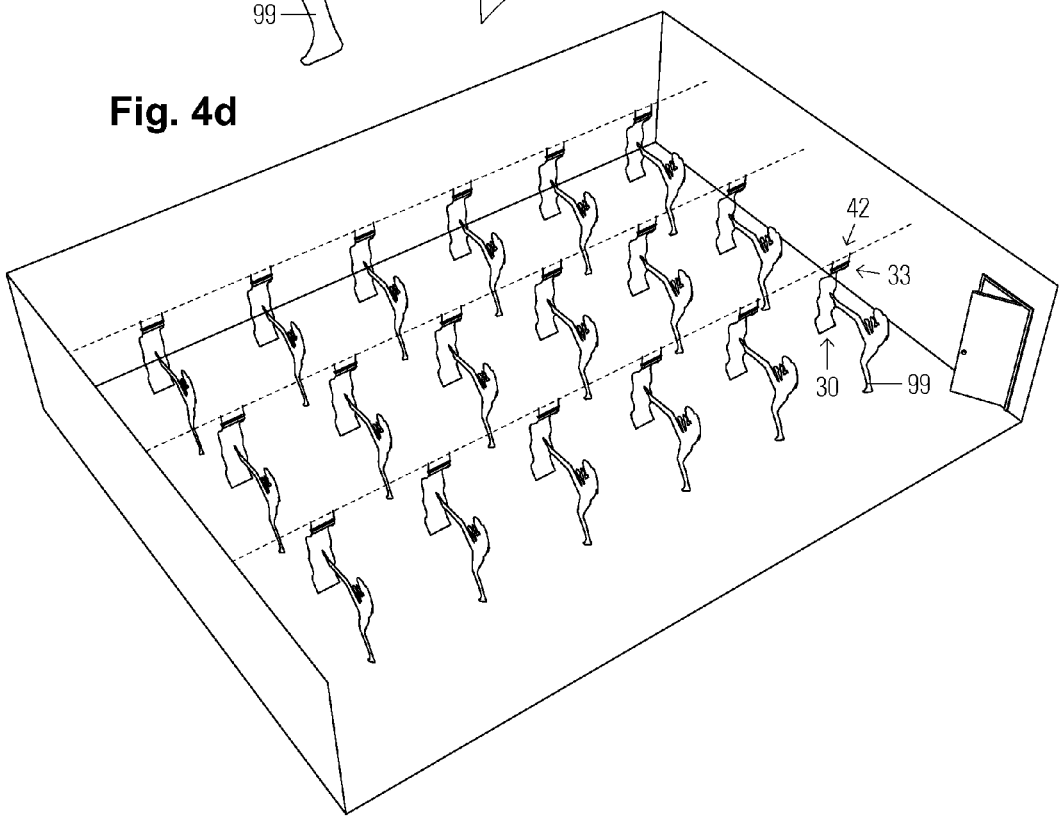
FIG. 4*d* is a perspective view of a fourth embodiment depicting a group of users in a training room with a multiplicity of individual flexible striking target stations.

As shown as in FIG. 4*d*, these simple options for suspending flexible striking targets 30 can create a multiplicity of single user training stations in any group training area such as a gym, aerobics room, or martial arts school. Optional, translucent flexible striking targets 30 further allow users 99 to maintain visual contact with instructor and others in the group.

Figure 5:
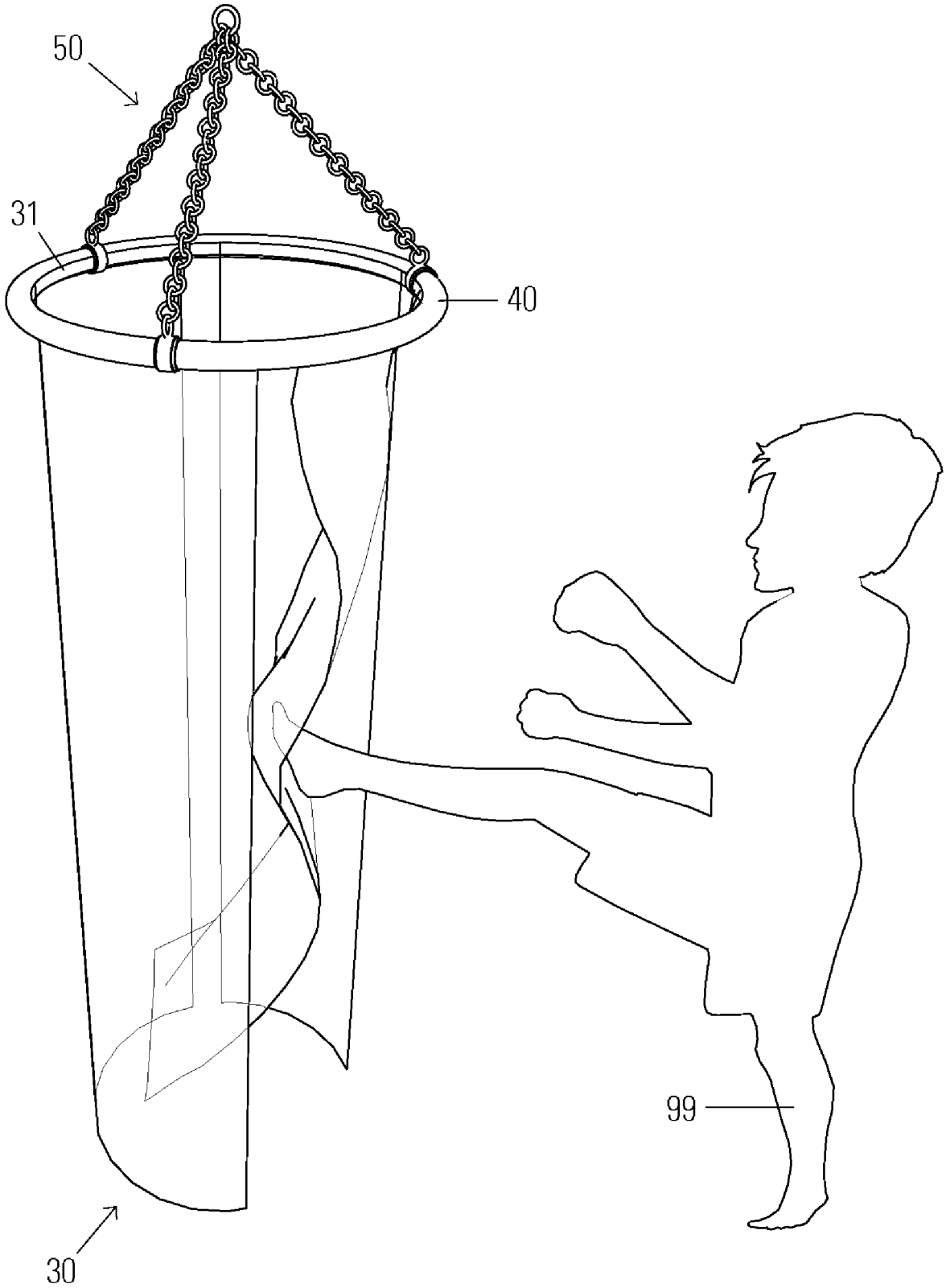
FIG. 5 is a perspective view of a fifth embodiment depicting a child user kicking a flexible striking target system enclosure suspended by an overhead frame.

In a fifth embodiment, the striking device in accordance with FIG. 1, as shown in FIG. 5, depicts a child user 99 kicking a child-size striking device comprising one or more flexible striking targets 30 suspended from an overhead frame 40 by means of hook-and-loop fasteners 31 to form either a sealed (not shown) or an unsealed, cylindrical enclosure, in the shape of a heavy punching bag. Said overhead frame 40 is a curved annular ring that can be made of a metal, plastic, rubber, wood, or fabricated of a blow or injection molded polymer material, or fitted sections of polyvinyl chloride (PVC) tubing. The overhead frame 40 can also be formed from contoured heavy density foam material with a suitable covering material, such as leather, canvas or vinyl (not shown). Alternatively, the overhead frame 40 can be inflatable, made of a durable covering such as plastic or rubber, and can be filled with any suitable stuffing, fluid or gas materials (not shown). Said device can hang from a ceiling stud, beam, or any suitable structure by means of a flexible mount 50, detailed in FIG. 13*c*.

Reducing the size of said components creates child-sized versions of said striking device. Suspending flexible striking targets 30 from an annular frame to form an unsealed, substantially cylindrical enclosure, simulates the familiar shape of a heavy punching bag, allowing the user 99 to move around the device and strike at nearly all levels and angles. An added benefit allows the user 99 to enter the enclosure and strike as if surrounded in tight quarters by one or more opponents. Said striking device can also be enlarged for adult use and still be light in weight and can be easily disassembled and packed for travel so that it can be used as a portable training unit. Said device is appropriate for home use because the flexible striking targets 30 react to being struck without bouncing and colliding into objects, causing damage to property.

Figure 13A:
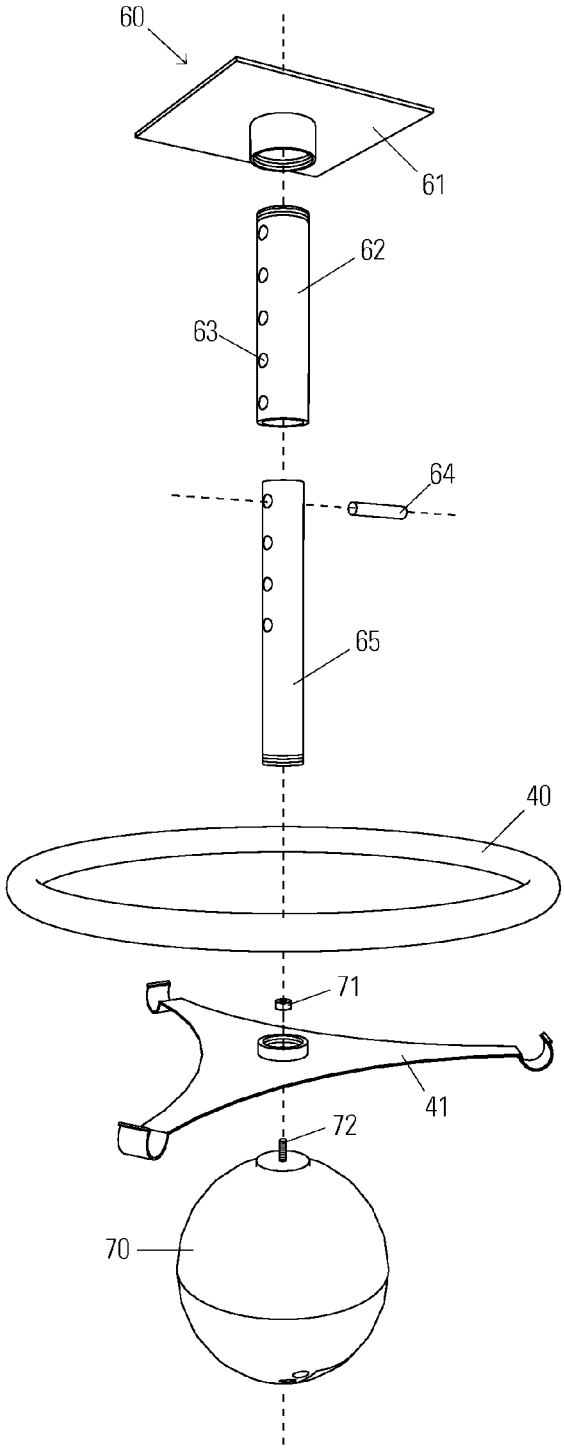
FIG. 13*a* is a perspective exploded view of the adjustable ceiling mount.
Figure 13B:
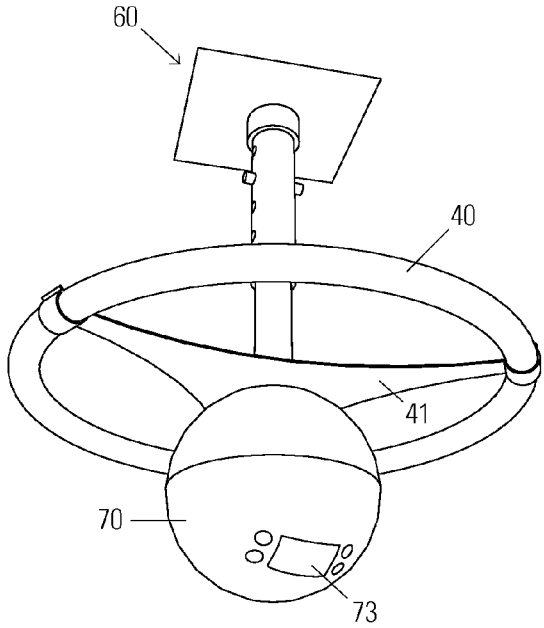
FIG. 13*b* is an upper perspective view of the adjustable ceiling mount.
Figure 13C:
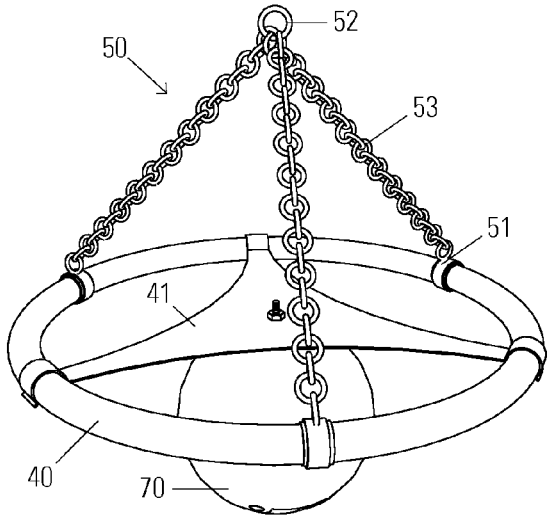
FIG. 13*c* is a lower perspective view of the flexible ceiling mount.

FIGS. 13*a*-13*c* shows how an optional electronics enclosure 70 can be attached to a frame mount 41, by means of a common nut 71 and suspension bolt 72, and suspended within the overhead frame 40.

Providing an optional electronics enclosure 70 allows for a variety of electronic components to be added in order to provide the user 99 convenient viewing access to audio and visual instructional training aids, biofeedback, and performance data while training.

Optionally, a rotating device (not shown) can be removably attached, by any conventional means, above the central ring 52 so that said mount can be made to rotate at variable, automatic speeds, which in turn rotates the flexible striking targets 30. Automatically moving targets, to be aimed at and struck at, develops hand-eye coordination and choice reaction timing, as well as simulate an attack from multiple opponents. Rotational speeds can be made slower or faster to alter difficulty.

Figure 6:
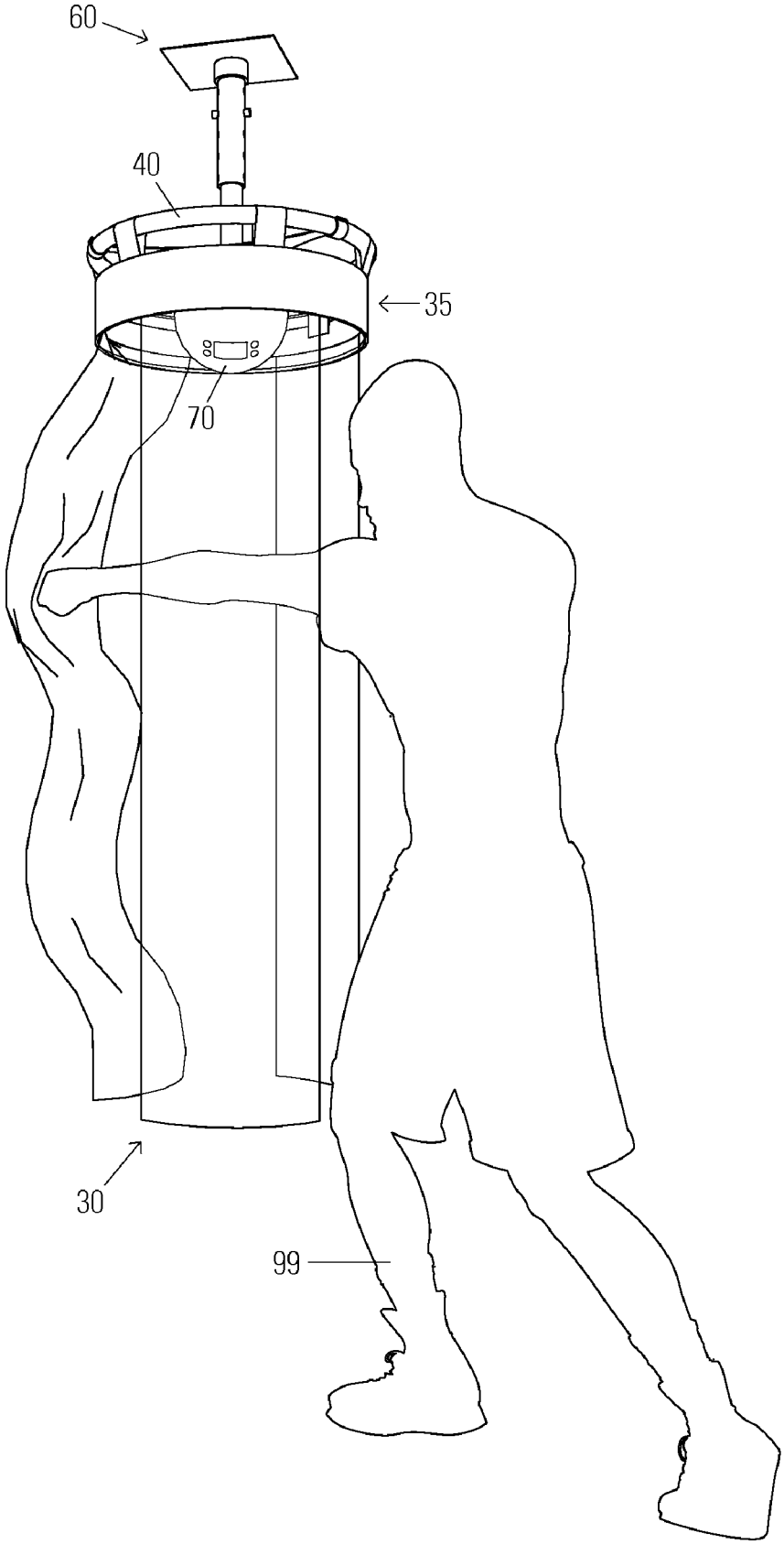
FIG. 6 is a perspective view of a sixth embodiment depicting a user punching a flexible striking target system enclosure suspended from an adjustable harness and overhead frame.

In a sixth embodiment, the striking device in accordance with FIG. 1, as shown in FIG. 6 depicts a user 99 striking an adult size striking device comprising one or more flexible striking targets 30 removably attached to the interior of a cylindrical frame harness 35 by means of hook-and-loop fasteners 31, 32. Said frame harness 35 can be removably attached to the overhead frame 40 which can be supported by an adjustable ceiling mount 60, which can also support the electronics enclosure 70.

The optional harness 35 forms a cylindrical enclosure of flexible striking targets 30 in the general size and shape of a typical heavy punching bag and can be made adjustable to either contract or expand the diameter of the cylindrical enclosure, giving the user 99 additional room to train within the enclosure, as if surrounded tightly by one or more opponents. The gaps between targets may also be progressively narrowed to increase difficulty when striking between targets for developing accuracy and precision.

As shown in FIG. 6, three flexible striking targets 30 can be positioned to simulate a three-dimensional, human form such that the two forward striking targets 30, facing the user 99, can simulate an opponent's left and right arms or legs while a rear striking target 30, farthest from the user 99, can simulate an opponent's head, trunk, or rear leg as primary targets to be struck or kicked.

In an optional embodiment, a horizontal ligature (not shown) such as but not limited to a cord, clip, or band can be removably fastened around two or more said flexible striking targets 30 to be drawn together, thus leaving openings between the striking targets so that the user's hands can be snugly enclosed for training tactile, higher sensitivity techniques, such as "sticking hands" and "pushing hands" practiced to some martial arts systems. Additionally, said binding device can be placed to simulate the tapering form of a human body, such as a head reduced to a neck; the upper body reduced to hips and legs (not shown).

Figure 7:
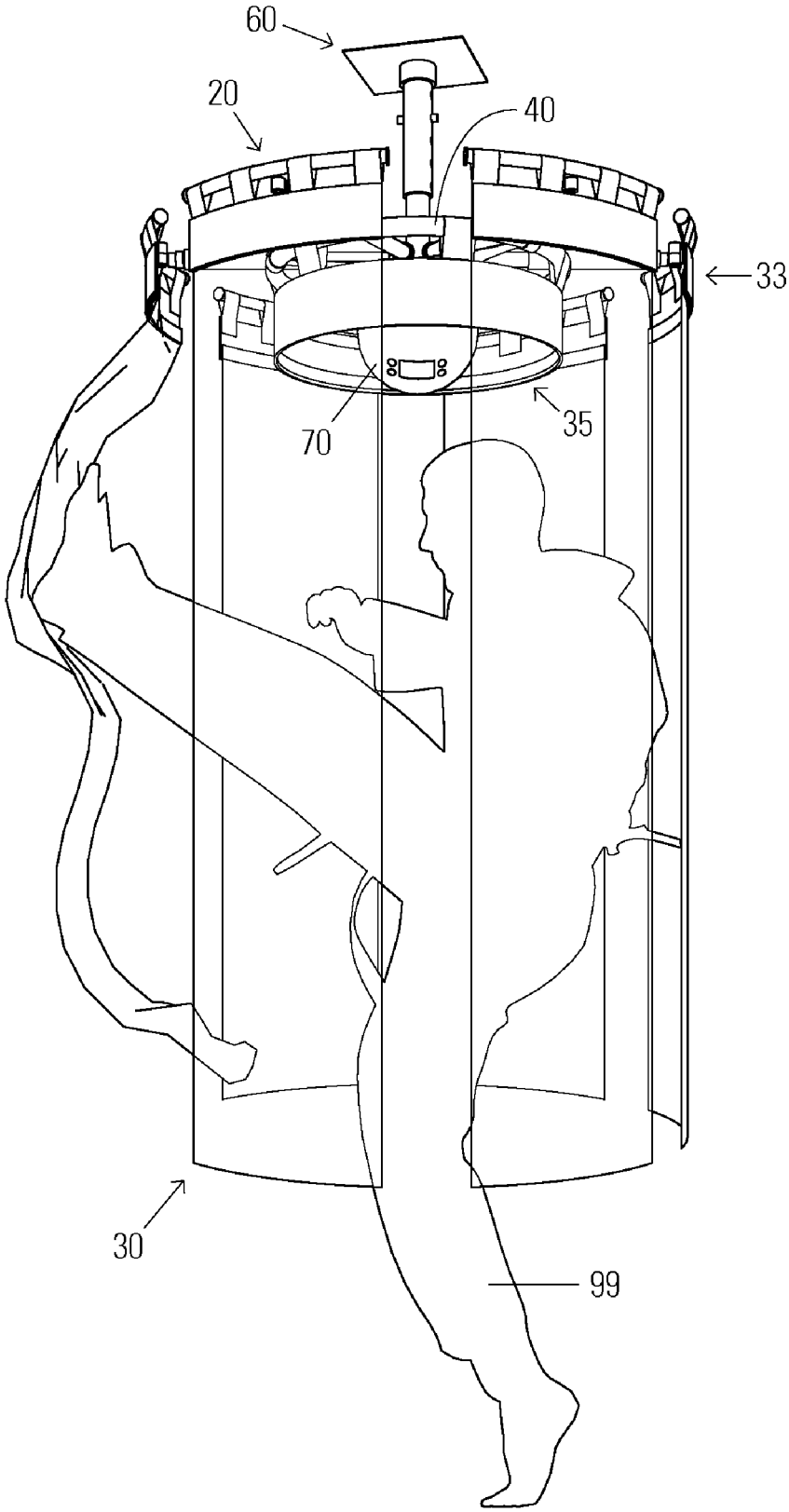
FIG. 7 is a perspective view of a seventh embodiment depicting a user kicking from within a flexible striking target system enclosure that is suspended from a plurality of sliding telescoping arms, at the closed position, attached to an overhead frame.

FIG. 7 depicts the same embodiment striking device as FIG. 6, except that six sliding telescopic arms 20 are fixedly attached to the overhead frame 40 to form a cylindrical enclosure of flexible striking targets 30, that are suspended from a plurality of T-harness assemblies 33, which can be removably attached to said sliding telescopic arms 20.

FIG. 7 depicts the sliding telescoping arms 20 in the closed position to simulate the user 99 being tightly surrounded by one or more opponents for training short kicks and strikes. FIG. 7 also depicts that the flexible striking targets 30 have been removed from the frame harness 35 to create more empty space in the core of the striking device. This quick and easy reconfiguration method of flexible striking targets 30 allows the user 99 to training multiple exercises and techniques together and in rapid succession without wasting valuable training time disassembling and reassembling the device. A plurality of independent flexible striking targets 30 presents a variety of striking options and angles.

Figure 8:
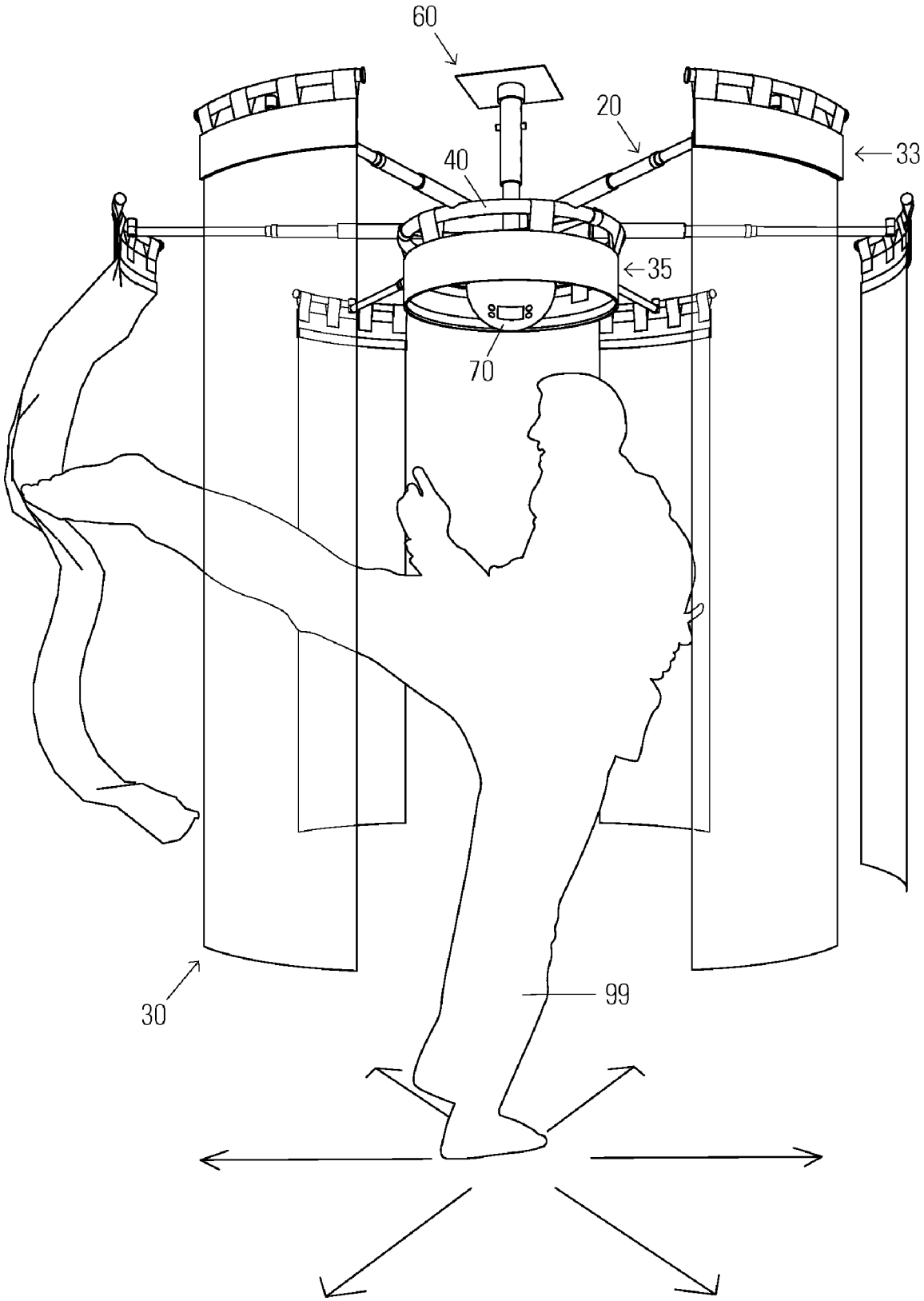
FIG. 8 is a perspective view of a seventh embodiment depicting a user kicking in all directions from within flexible striking target system enclosure that is suspended from a plurality of sliding telescoping arms, at the full-position, attached to an overhead frame.

FIG. 8 depicts the same embodiment striking device as FIG. 7, except that the sliding telescopic arms 20 are now in the full-open position.

This target setup simulates a user 99 more distantly surrounded by one or more opponents for training 360-degree standing kicking drills, long-range striking techniques, and advanced footwork patterns for hiding, stealing, and closing distances. Multiple flexible striking targets 30 can together simulate one opponent moving from one position to another, as in moving around a fighting ring or street.

Figure 9:
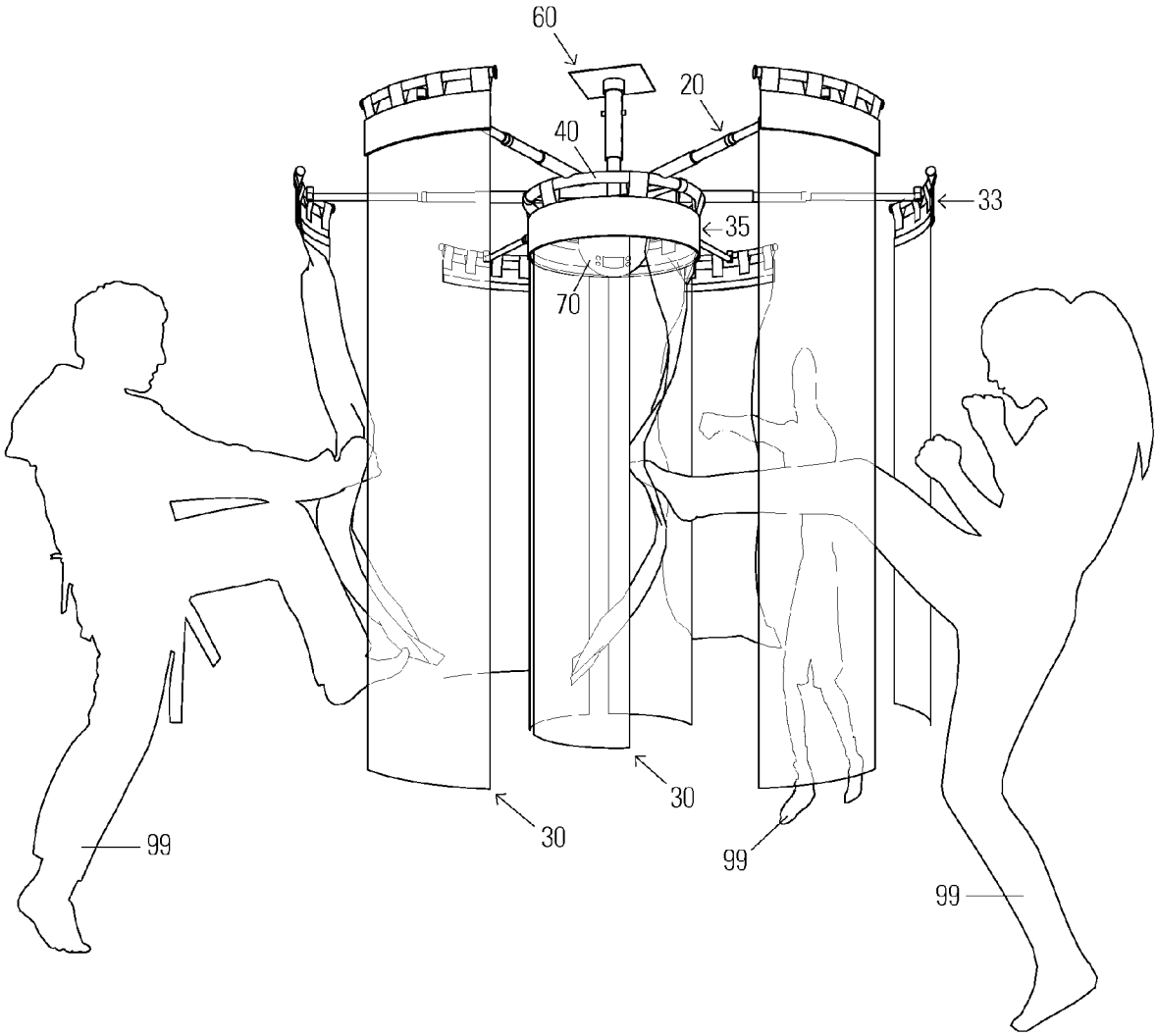
FIG. 9 is a perspective view of a seventh embodiment depicting three users training simultaneously on a single flexible striking target system enclosure that is suspended from an adjustable harness and a plurality of sliding telescoping arms, at the full-open position, attached to an overhead frame.

FIG. 9 depicts the same embodiment striking device as FIGS. 7 and 8, except that the flexible striking targets 30 have been attached to the frame harness 35 to create a second, inner cylindrical enclosure in the center of the striking device. FIG. 9 also depicts two users 99 kicking and striking at the outer cylindrical enclosure of flexible striking targets 30, with a third user 99 kicking at the second, inner cylindrical enclosure of flexible striking targets 30.

This setup of inner and outer cylindrical enclosures allows for multiple users 99 to train simultaneously on the same striking device and, if using translucent flexible striking targets 30, maintain visual contact with one another and train safely.

Figure 10A:
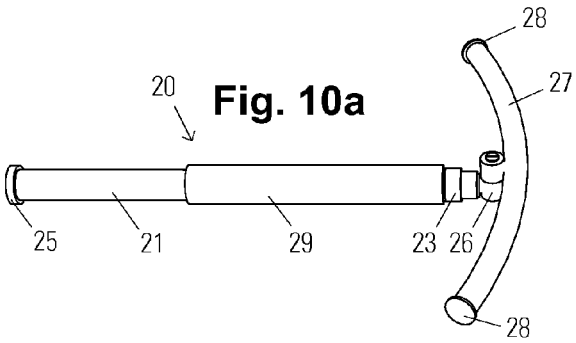
FIG. 10*a* is an upper perspective view of a sliding telescopic arm at the closed position.
Figure 10B:
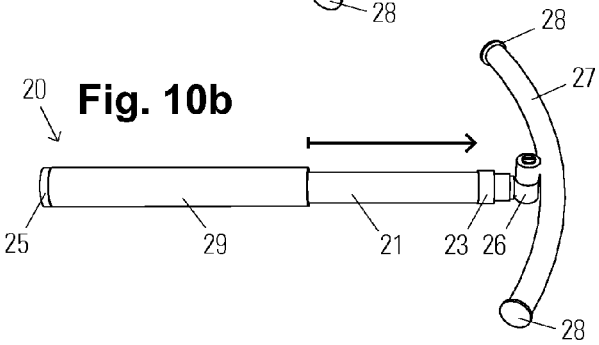
FIG. 10*b* is an upper perspective view of a sliding telescopic arm at the mid-open position.
Figure 10C:
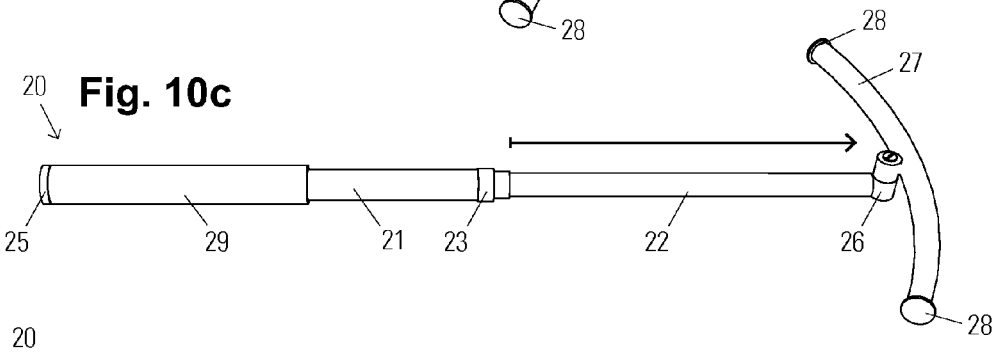
FIG. 10*c* is an upper perspective view of a sliding telescopic arm at the full-open position.
Figure 10D:
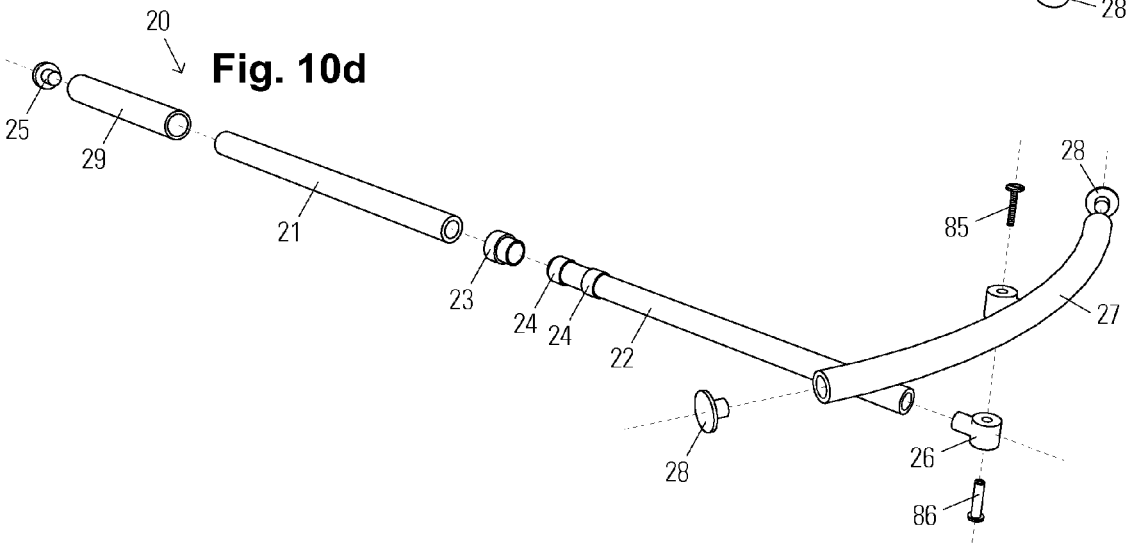
FIG. 10*d* is an upper perspective exploded view of sliding telescopic arm.

FIG. 10*a* is a perspective view of the sliding telescopic arm 20 in the closed position and can be made extensible in one or more actions. FIG. 10*b* depicts the first action of an outer sliding telescoping arm 21 sliding outward within an arm mount sleeve 29 to reach out to the mid-open position. FIG. 10*c* depicts the second action of an inner sliding telescopic arm 22 sliding outward to the full-open position. FIG. 10*d* is an exploded perspective view of a sliding telescoping arm 20 consisting of the arm mount sleeve 29 made of metal, plastic or wood, and can have an inserted bushing (not shown) of a low-friction material so that the outer sliding telescoping arm 21 can be captured in a manner to allow it to slide freely within the arm mount sleeve 29. An arm stop cap 25 can be snugly inserted into the open inner end of the outer sliding telescoping arm 21 to stop it from completely detaching from the arm mount sleeve 29. The inner sliding telescoping arm 22 with friction bushings 24, fixedly attached by means of adhesive, slides freely within the outer sliding telescoping arm 21. An arm stop sleeve 23 can be snugly inserted into the open outer end of the outer sliding telescoping arm 21 to stop the inner sliding telescoping arm 22 from completely detaching when extending it. A T-swivel 26 or similar connector (not shown) can be inserted into the outer open end of the inner sliding telescoping arm 22 to connect the curved T-head 27 by means of an upper bolt 86 and a lower receiving nut 85 inserted through said T-swivel 26, defining the preferential hinge axis of the curved T-head 27. Additionally, T-caps 28 can be inserted into each open end of the curved T-head 27 to prevent the T-harness 33 from sliding off during normal use.

The sliding telescopic arms 20 shorten or lengthen to easily adjust the diameter of the striking device and position of each flexible striking target 30. This function combines multiple usages and training exercises into one unit so that multiple pieces of equipment are not needed, saving costs and valuable space. The sliding telescopic arms 20 also allow the device to be easily reduced in size to save space when not in use.

FIGS. 11*a*-11*c* are perspective views of the overhead frame 40 with a plurality of sliding telescopic arms 20 fixedly attached by any means, such as but not limited to adhesive material, blow or injection molding, or by welding, depending on the materials being used for construction.

FIG. 11*a* depicts the plurality of sliding telescopic arms 20 in the closed position and can be made extensible in one or more actions. FIG. 11*b* depicts the first action of the outer sliding telescoping arms 21 sliding outward within the arm mount sleeves 29 to reach out to the mid-open position. FIG. 11*c* depicts the second action of the inner sliding telescopic arms 22 sliding outward to the full-open position. FIGS. 11*a*-11*c* also show how the curved T-heads 27 can be adjusted to swivel horizontally, thereby changing the face angles of the flexible striking targets 30 for different striking exercises.

Figure 12A:
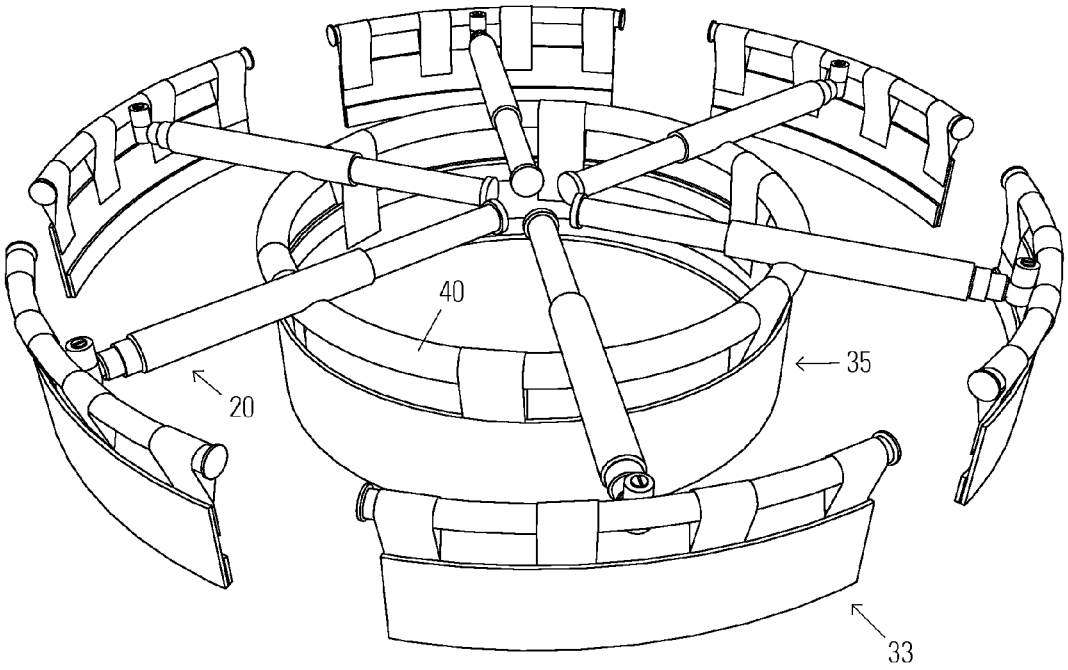
FIG. 12*a* is an upper perspective view of the overhead frame with a plurality of sliding telescoping arms attached, at the closed position, with the frame harness and T-harnesses removably attached.
Figure 12B:
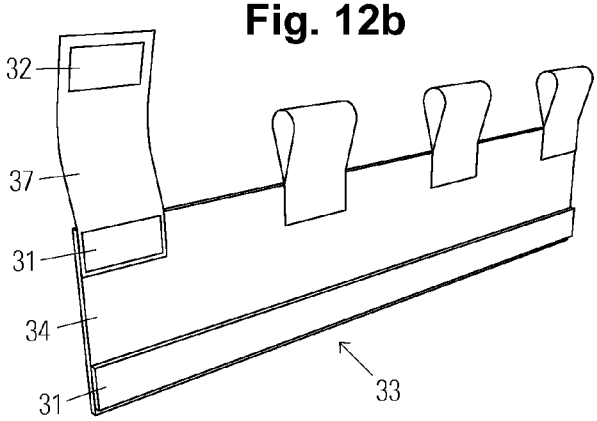
FIG. 12*b* is an interior perspective view of the T-harness.
Figure 12C:
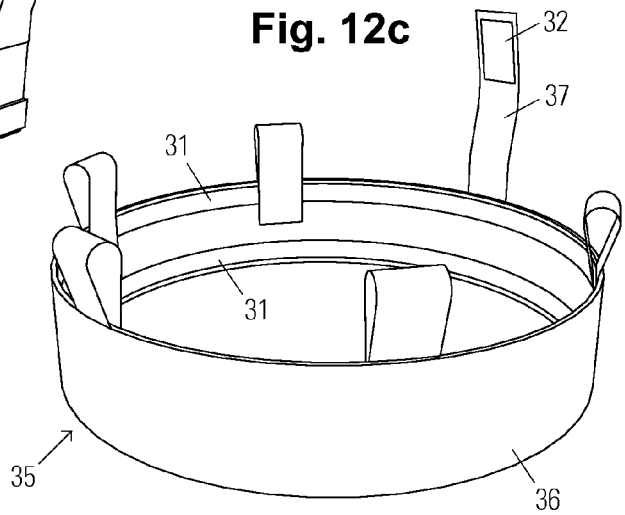
FIG. 12*c* is an upper perspective view of the frame harness.

FIG. 12*a* is a perspective view of the overhead frame 40, with fixedly attached, sliding telescopic arms 20 in the closed position, with frame harnesses 35 and T-harnesses 33 removably attached to the overhead frame 40 and curved T-heads 27 respectively by means of one or more fastening straps 37 connected by strips of hook-and-loop fasteners 31, 32. FIG. 12*b* is a perspective view of the T-harness 33 that can be removably attached to the curved T-head 27 by fastening straps 37 that can be fixedly attached at one end to a T-harness body 34, in any conventional manner such as stitching, and removably attached at the other end, by means of hook-and-loop fasteners 31, 32. The T-harness 33 can support at least one flexible striking target 30 which can be releasably connected by means such as, but not limited to, hook-and-loop fasteners 31, 32. FIG. 12*c* is a perspective view of the frame harness 35 that can be removably attached to the overhead frame 40 by fastening straps 37 that can be fixedly attached at one end to a frame harness body 36, in any conventional manner such as stitching, and removably attached at the other end, by means of hook-and-loop fasteners 31, 32. Both the frame harness body 36 and T-harness body 34 can be made of, but not limited to canvas, leather, vinyl, plastic, or other such durable material, and can surround or contain an interior fill or a semi-rigid material, such as foam or plastic, to provide shape and neatness of appearance (not shown).

The optional frame harness 35 can act as a support between the overhead frame 40 and the flexible striking targets 30, while the T-head harness 33 can act as a support between the curved T-head 27, at the end of each sliding telescoping arm 20, and flexible striking targets 30. The optional frame harness 35 may be made to expand by conventional means (not shown) in order to contract or expand the diameter of the core cylindrical enclosure of said striking device.

It may also be appreciated, however, that both the frame harness 35 and T-harness 33, can be eliminated so that the flexible striking targets 30 can be removably attached directly to the overhead frame 40 and curved T-head 27 respectively, by means of means such as, but not limited to, strips of hook-and-loop fasteners 31, 32, or by other means such as buckles, snaps, or adhesive materials, as shown in FIG. 3*c* and FIG. 5.

FIG. 13*a* is a perspective exploded view of an adjustable ceiling mount 60, used to mount FIGS. 6-9, and which can be made of any rigid material such as, but not limited to, metal, or plastic tubing. A ceiling plate 61 can be fixedly attached, in any conventional manner, into a ceiling stud or beam (not shown) to suspend a down rod sleeve 62, consisting of one or more fixed sections or telescoping with an inner sliding telescopic down-rod 65 releasably attached by means such as a locking pin 64 inserted through aligned drilled holes 63 of said down rods 62, 65. Said down rods 62, 65 can be of one or more sections having external threads at their top and bottom ends. The external threads on the top end of the down rod sleeve 62 can be configured to engage the internal threads of the lower section of the ceiling plate 61. Accordingly, the external threads on the bottom end of the inner down-rod 65 can be configured to engage the internal threads of the frame mount 41, which can either fixedly or removably attach to the overhead frame 40 in any conventional manner such as but not limited to clamps, screws and nuts, pressure receptacles, adhesive, injection molding, or welding. Additionally, an optional electronics enclosure 70 can be removably attached by a mounting bolt 72 that inserts through the center, underside of the frame mount 41 to be secured in place by a common nut 71. FIG. 13*b* is a perspective view of the adjustable ceiling mount 60, assembled from FIG. 13*a* and positioned to clearly see the electronics control window 73 on the electronics enclosure 70. FIG. 13*c* is a perspective view of the flexible mount 50 consisting of flexible gaffs 53 to support the overhead frame 40 by means such as, but not limited to, frame clamps 51. Said flexible gaffs 54 can be made of, but not limited to chain, cord, bungee or similar such material, are joined at the top by a central ring 52, which can be removably attached to means, such as but not limited to, an eyehook which can be fixedly screwed into a ceiling stud, beam, suitable structure (not shown). Optionally, an extension gaff (not shown) consisting of, but not limited to, chain, rope or bungee, can be removably attached to central ring 52, by any conventional means, so that entire flexible mount 50 can be raised or lowered, in any conventional manner, to suit both adults and children of all sizes.

The optional electronics enclosure 70 can be fixedly attached to various frame supports so as to provide audio and visual aids, or other means of instruction, to a user 99 while training or exercising. Attachment to the underside of the overhead frame 40 provides convenient viewing and access to controls.

Figure 14A:
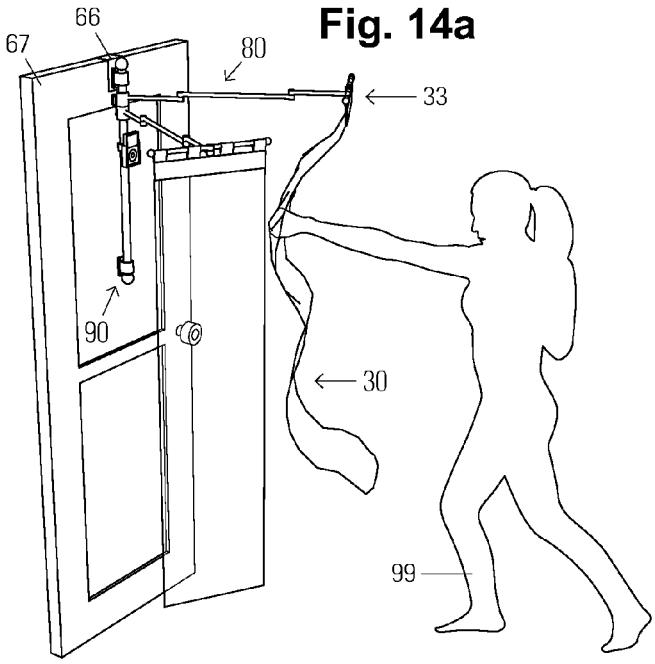
FIG. 14*a* is a perspective view of an eighth embodiment depicting a user punching a flexible striking target system suspended from door-mounted swing arms.
Figure 14B:
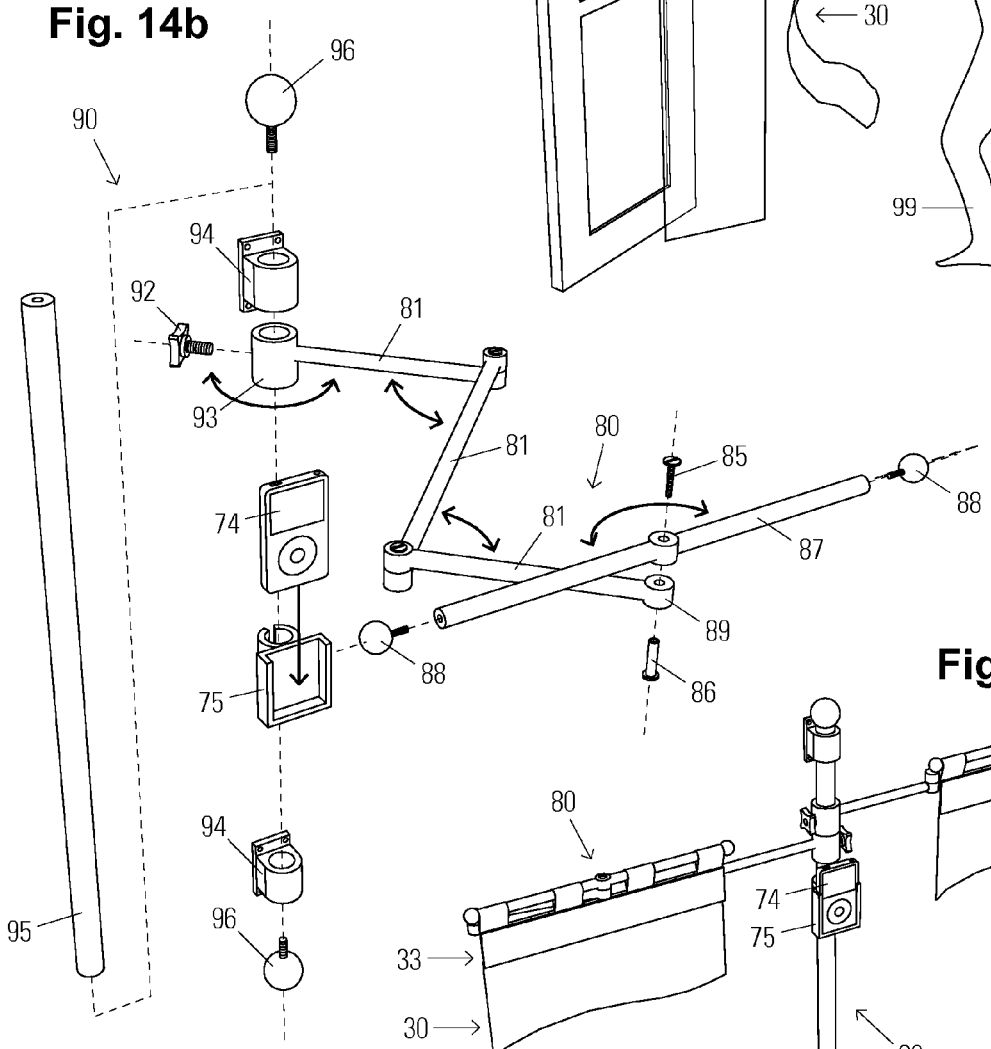
FIG. 14*b* is an upper perspective exploded view of a swing arm and mount.
Figure 14C:
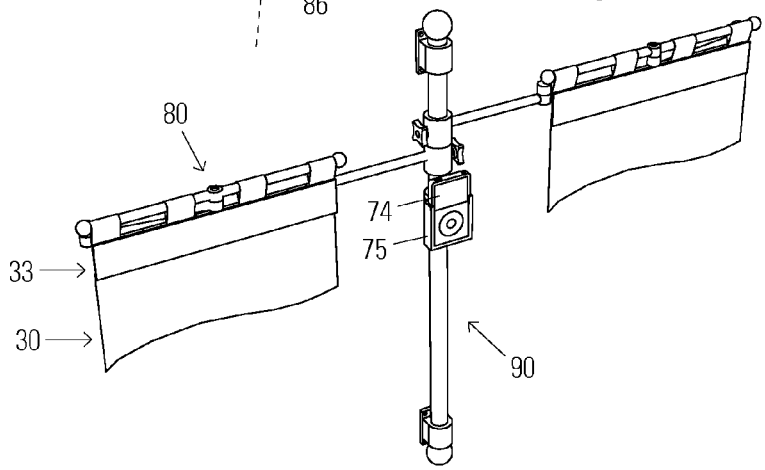
FIG. 14*c* is a lower perspective view of an eighth embodiment flexible striking target system suspended from a swing arms, in the closed position.

In an eighth embodiment, the striking device in accordance with FIG. 1, as shown in FIG. 14*a*, is comprised of one or more outwardly projecting swing arms 80 that can be removably attached to a vertical swing mount 90 that can be fixedly attached to a wall, door, beam, or other suitable vertical surface, using conventional means, such as wood screws (not shown.) An over-the-door clip 66 can be used to removably attach said swing mount 90 to the top of a door 67. Flexible striking targets 30 can be removably attached to T-harnesses 33 that can be removably attached to a swing-T 87 at the outer end of each swing arm 80. Alternatively, T-harness 33 may be omitted and the flexible striking targets 30 can be removably attached directly to the swing-T 87 by means of hook-and-loop fasteners as shown in FIG. 3*c* A frame deck 75 can be attached, by any conventional means, to the vertical swing mount 90, to hold an audio/visual instructional device, such as an Apple iPod Video 74, or other means of instructional materials. FIG. 14*b* is an exploded perspective view of the striking device shown in FIGS. 14*a* and 14*c*. The swing mount 90 consists of a two or more wall frame mounts 94 that can be fixedly attached to a wall stud, door, beam, or other suitable vertical surface, by conventional means, such as wood screws (not shown) in order to secure a wall frame shaft 95 parallel to said mounting surface. Said wall frame shaft 95 inserts through the openings of one or more wall frame mounts 94 and is held in place by end caps 96 threaded into each end of the wall frame shaft 95. One or more outwardly projecting swing arms 80 can be removably attached to the wall frame shaft 95 by a frame swing hinge 93 fixedly attached to the inner end of the swing arm 80. Said frame swing hinge 93 includes a securing knob 92 that can tighten to apply pressure and secure in position said swing arm 80 to said wall frame shaft 95. Said swing arms 80 can be made of any rigid material such as, but not limited to, metal, plastic, or wood. Said swing arm 80 includes one or more swing arm sections 81 that can be extensibly joined by conventional means, such as an upper bolt 85 and lower receiving nut 86 inserted through a swivel joint 89 at each joint. At the outward end of the swing arm 80, the swing T-head 87 can be removably or fixedly attached to a swivel joint 89 in the above said manner. The swing T-head 87 can be capped at each end by the swing T-caps 88 to prevent the T-harness 33 from sliding off during normal use. An optional frame deck 75 can be releasably attached to the wall frame shaft 95 to provide support for viewing and accessing instructional aids or an entertainment device, such as an iPod 74, as sold by Apple Computer Inc, Cupertino, Calif. FIG. 14*c* is a close-up, perspective view of the striking device shown in FIGS. 14*a* and 14*c* with all parts assembled and said swing arms 80 folded flat against the mounting surface.

One or more swing arms 80 with T-harnesses 33 and attached flexible striking targets 30 may be placed in the closed position against the mounting surface of a wall or, optionally, a door 67, so that when the swing arm 80 is opened, it is made to extend an outward fashion away from the mounting surface where it can be used safely for training and exercise. One or more swing arms 80 can be placed and adjusted up or down along the vertical swing mount 90 to produce different target training configurations. Furthermore, the swing T-head 87 can be rotated horizontally in 360 degrees to vary the angle of flexible striking targets 30 to further alter training configurations. Optionally provided, is a frame deck 75 that can hold various means of instructional aids such as the Apple iPod Video 74, while the user 99 is training or exercising.

Although the prior descriptions are specific, they should not be considered as a limitation on the scope of the striking device and only serve as examples of preferred embodiments. Many variations are possible within the methodology of said striking devices. For example, different frame supports, attachment methods, fasteners, materials, configurations, etc. can be used where not specifically indicated otherwise. The relative positions of the elements can vary, and the shapes of the elements can vary. For purposes of the prior description, special terms relate to the striking device, as it is oriented in the drawing figures. However, it is to be understood that the striking device can assume various alternative orientations and, therefore, such terms should not be considered limiting except where expressly specified to the contrary. It is also understood that specific devices illustrated in the attached drawings, and described in the prior description, are simply embodiments. Hence, relative dimensions and other physical characteristics related to the embodiments disclosed are not to be considered as limiting.

Many other adjustable arm variations are possible, but not shown. For example, one or more outwardly projecting, flexible gooseneck arms (not shown) made from, but not limited to metal, wire, plastic, or other suitable material that is bendable into different shapes and retains such shapes when released, can be used to support one or more flexible striking targets 30. Said gooseneck arms can be supported by a standing floor base weighted and broad enough to maintain support under normal use. Optionally, said gooseneck arms can be removably attached to a wall/ceiling plate mount 59, or over-the-door clip 66.

Many other mounting variations are also possible, but not shown. For example, at least one wall frame shaft 95 can be directly mounted to either to a ceiling, floor, or standing floor base, substantially weighted or broad enough to maintain support when being used (not shown) to form a vertical frame structure suitable for supporting a plurality of swing arms 80. Said vertical frame structure allows for swing arms 80 to be attached and swiveled 360-degrees for positioning multiple flexible striking targets 30 in virtually any configuration.

All said embodiments are ideal for enthusiasts of martial arts, boxing, physical fitness, and anyone wishing to combine the advantages of non-force impact training with the targeting advantages of force impact striking devices to practice ancient Taoist principles of delivering greater speed and power while using less effort.

Targeted non-force impact training removes the rebound energy otherwise generated by all prior art striking devices so that said embodiments can be used safely by children, seniors, the physically handicapped, and those with injuries or disabilities. Said embodiments are also well suited for therapeutic modalities, such as physical therapy, injury recovery and health maintenance.

All embodiments previously described are ideal for home use because: they are light in weight and do not require mounting to weight bearing or reinforced structures; they are noiseless when used and do not require springs to help dampen the transfer of vibrations and noise through walls and ceilings; they are neither heavy, nor bulky so that they can be packaged and shipped inexpensively to home use customers in the smallest possible containers; and they are low in cost and modular so that users may custom build and expand their units to add features and capabilities as desired.

We claim:

1. A flexible striking target for providing low impact when struck comprising:

at least one sheet of flexible material;

at least one striking location disposed thereon the sheet(s) of flexible material;

a means for removably securing the flexible striking target to a support; and, wherein the support is a swivelable curved-T head.

2. The flexible striking target of claim 1 wherein the curved-T head is disposed at the end of a sliding telescoping arm.

3. The flexible striking target of claim 2 wherein the sliding telescoping arm is hand held whereby the flexible striking target may be moved by a holder to simulate the movement of a life-form.

* * * * *